US008596752B2

(12) United States Patent
Hirata et al.

(10) Patent No.: US 8,596,752 B2
(45) Date of Patent: Dec. 3, 2013

(54) INKJET RECORDING APPARATUS

(75) Inventors: Kenichi Hirata, Nagoya (JP); Kengo Takeda, Inazawa (JP)

(73) Assignee: Brother Kogyo Kabushiki Kaisha, Nagoya-shi, Aichi-Ken (JP)

( * ) Notice: Subject to any disclaimer, the term of this patent is extended or adjusted under 35 U.S.C. 154(b) by 306 days.

(21) Appl. No.: 13/071,780

(22) Filed: Mar. 25, 2011

(65) Prior Publication Data

US 2012/0001984 A1 Jan. 5, 2012

(30) Foreign Application Priority Data

Jun. 30, 2010 (JP) ..... 2010-149589

(51) Int. Cl.
*B41J 2/165* (2006.01)

(52) U.S. Cl.
USPC ..... 347/29; 347/32; 347/22; 347/34

(58) Field of Classification Search
USPC ..... 347/29, 32, 22, 34
See application file for complete search history.

(56) References Cited

FOREIGN PATENT DOCUMENTS

| | | | | |
|---|---|---|---|---|
| JP | 09-085959 | * | 3/1997 | ..... B41J 2/165 |
| JP | H09-085959 | A | 3/1997 | |
| JP | 2004-291482 | A | 10/2004 | |
| JP | 2006-007455 | A | 1/2006 | |

* cited by examiner

*Primary Examiner* — Henok Legesse
(74) *Attorney, Agent, or Firm* — Baker Botts L.L.P.

(57) ABSTRACT

An inkjet recording apparatus includes a record head having an ejection surface and a conveyance mechanism having a conveyance surface which passes through a position facing the ejection surface. The inkjet recording apparatus further includes: a capping mechanism which has a annular component provided around the record head to circumscribe the record head and is able to achieve capping such that the ejection surface is covered with the conveyance surface and the annular component as the annular component is caused to contact the conveyance surface; a recognition unit which recognizes a position of a first region on the conveyance surface, the first region being not smaller than an enclosed range on the conveyance surface which range is circumscribed by the annular component and being a region in which a predetermined amount or less ink adheres to an arbitrary range which is within the first region and is identical in size with the enclosed range; and a control unit which controls the capping mechanism and the conveyance mechanism so that the capping is achieved in such a way that the first region of the conveyance surface recognized by the recognition unit contacts the annular component.

10 Claims, 10 Drawing Sheets

INKJET RECORDING APPARATUS

CROSS REFERENCE TO RELATED APPLICATION

The present application claims priority from Japanese Patent Application No. 2010-149589, which was filed on Jun. 30, 2010, the disclosure of which is herein incorporated by reference in its entirety.

BACKGROUND OF THE INVENTION

1. Field of the Invention

The present invention relates to an inkjet recording apparatus recording an image onto a recording medium.

2. Description of the Related Art

A known inkjet recording apparatus caps the nozzle surface (ejection surface) of a record head by a cap and a conveyance belt in such a way that the cap provided around the record head is caused to closely contact the conveyance belt.

SUMMARY OF THE INVENTION

According to this known inkjet recording apparatus, the capping of the ejection surface, i.e. the formation of a closed space defined by the ejection surface, the cap, and the conveyance belt, is carried out by causing the cap to closely contact a desired portion of the surface of the conveyance belt. When the capping is in action, aqueous ink adhering to the surface of the conveyance belt opposing the ejection surface is often dry ink which adhered to the surface while ago, in other words, thickened ink. Since such thickened ink absorbs moisture from the surrounding atmosphere (i.e. is hygroscopic), the moisture of the ink inside the ejection opening is reduced. For this reason, the ink inside the ejection opening gets dry even if the capping is in action.

An object of the present invention is to provide an inkjet recording apparatus in which ink in ejection openings is hardly dried while the capping is in action.

The inkjet recording apparatus of the present invention includes a recording head, a conveyance mechanism, a capping mechanism, a recognition unit, and a control unit. The record head has an ejection surface on which a plurality of ejection openings ejecting aqueous ink are funned. The conveyance mechanism has a conveyance surface passing through a position facing the ejection surface and conveys, by moving the conveyance surface in a travel direction, a recording medium supported on the conveyance surface so as to cause the recording medium to pass through the position facing the ejection surface. The capping mechanism has a annular component provided around the record head to circumscribe the record head and is able to achieve capping such that the ejection surface is covered with the conveyance surface and the annular component as the annular component is caused to contact the conveyance surface. The recognition unit recognizes a position of a first region on the conveyance surface, the first region being not smaller than an enclosed range on the conveyance surface which range is circumscribed by the annular component and being a region in which a predetermined amount or less ink adheres to an arbitrary range which is within the first region and is identical in size with the enclosed range. The control unit controls the capping mechanism and the conveyance mechanism so that the capping is achieved in such a way that the first region of the conveyance surface recognized by the recognition unit contacts the annular component.

BRIEF DESCRIPTION OF THE DRAWINGS

Other and further objects, features and advantages of the invention will appear more fully from the following description taken in connection with the accompanying drawings in which:

FIG. 2A is a schematic plan view of the heads and the conveying unit shown in FIG. 1, whereas

DESCRIPTION OF THE PREFERRED EMBODIMENTS

Figure 1:
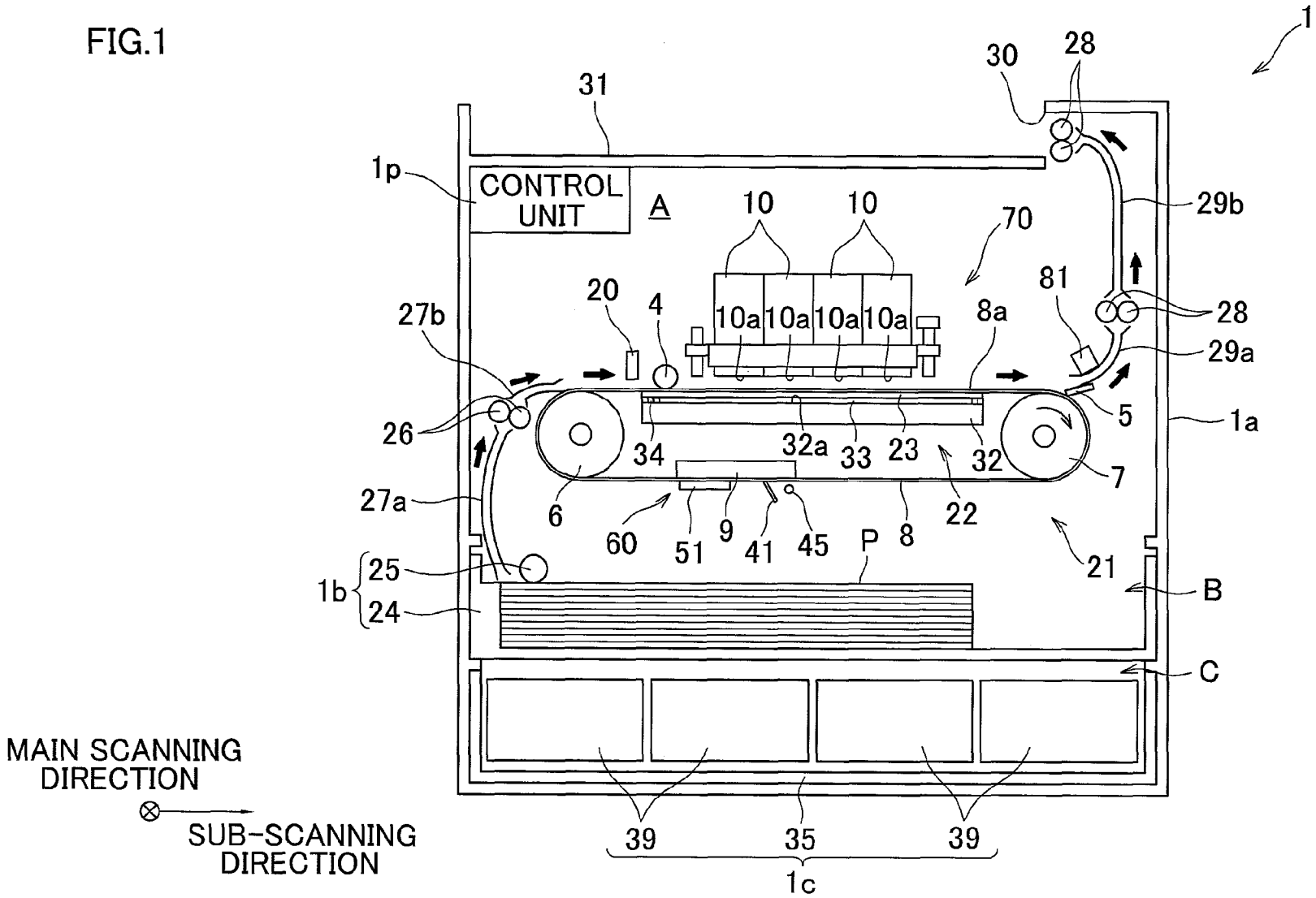
FIG. 1 is a schematic side elevation outlining an inkjet printer according to an embodiment of the present invention.

First, the overall structure of an inkjet printer 1 according to embodiment of the present invention will be described with reference to FIG. 1, FIG. 2A, and FIG. 2B.

The printer 1 has a rectangular parallelepiped chassis 1*a*. On top of the chassis 1*a* is provided an area 31 where ejected sheets are stacked. The inside space of the chassis 1*a* is divided into spaces A, B, and C sequentially from the top. The spaces A and B are spaces having therein a conveying path connected to the area 31. The space C accommodates four ink cartridges 39 serving as an ink supply source for supplying ink to inkjet heads 10.

In the space A are disposed four inkjet heads 10 (hereinafter, heads 10), a capping mechanism 70 restraining the thickening of ink in the four heads 10 which are record heads ejecting magenta, cyan, yellow, and black inks, a capping mechanism 70 restraining the thickening of ink in each head 10, a conveying unit 21 which conveys a sheet P in a conveyance direction (left to right in FIG. 1), a wiping mechanism 60 which is wiping means provided around the lower edge of the conveying unit 21, and a guide unit which guides the sheet P. On top of the space A is a control unit 1*p*. The control unit 1*p* controls operations of various parts of the printer 1 so as to administrate the entire operation of the printer 1.

The control unit 1*p* controls recording operations (conveying sheets P by various components of the printer 1, ejection of ink in sync with the conveyance of sheets P, or the like), based on image data supplied from an external apparatus. In response to a maintenance instruction, the control unit 1*p* controls the conveying unit 21, the wiping mechanism 60, and the capping mechanism 70. The maintenance indicates a capping operation to cap the ejection surfaces 10*a* of the four heads 10 and/or a wiping operation to remove foreign matters (ink, paper powder, or the like) on the outer surface 8*a* of the conveyance belt 8 when the capping is performed. The details of the maintenance will be given later with reference to FIG. 8.

The conveying unit 21 includes belt rollers 6 and 7, an endless conveyance belt 8 which is stretched between the rollers 6 and 7 and has a surface (conveyance surface) 8*a* which passes through positions opposing the ejection surfaces 10*a* of the heads 10, a nipping roller 4 and a peeling plate 5 provided outside the conveyance belt 8, and an attracting platen 22 provided inside the conveyance belt 8. The belt roller 7 is a drive roller which is rotated clockwise in FIG. 1 by a conveyance motor 121 (see FIG. 6) driven by the control unit 1*p*. As the belt roller 7 rotates, the conveyance belt 8 moves in the direction indicated by the thick arrow in FIG. 1. The belt roller 7 is provided with an encoder 80 (see FIG. 6). The number of rotations of the belt roller 7 is measured by this encoder 80. The belt roller 6 is a driven roller which is rotated anticlockwise in FIG. 1 in accordance with the travel of the conveyance belt 8.

The conveyance belt 8 is made of a material such as polyimide and fluororesin, has a volume resistivity of about 108 to 1014 ohm centimeters, and is flexible. Alternatively, the conveyance belt 8 may be made of another material having a similar volume resistivity and flexibility. The conveyance belt 8 forms a ring and the outer surface 8*a* also forms a ring. As shown in FIG. 2A and FIG. 2B, the outer surface 8*a* is provided with a preliminary ejection region H which is long in the main scanning directions. The preliminary ejection region H is a region to which later-described preliminary ejection is carried out. The liquid repellent coating is applied onto the region by means of fluororesin or silicon water repellent, and hence the region has higher liquid repellency than the other regions on the outer surface 8*a*. When the conveyance belt 8 is made of fluororesin, the preliminary ejection region H is coated with fluororesin which includes a larger amount of fluorine than the fluororesin of which the conveyance belt 8 is made. The preliminary ejection region H is formed across the entire width of the conveyance belt 8. Moreover, the preliminary ejection region H is shorter than the sheet P and a later-described sub wiper 51, in the sub-scanning directions. The sub-scanning directions indicate the directions in parallel to the conveyance direction of sheets P by the conveying unit 21, whereas the main scanning directions indicate directions orthogonal to the sub-scanning directions in the horizontal plane. On the outer surface 8*a* is provided an unillustrated mark which opposes a later-described sheet sensor 20. Since the reflectance of the mark is different from that of the outer surface 8*a*, the mark is detectable by the sheet sensor 20. The control unit 1*p* is able to grasp the position of the preliminary ejection region H on the outer surface 8*a* with reference to the position of the mark and the number of rotations of the belt roller 7.

Figure 2A:
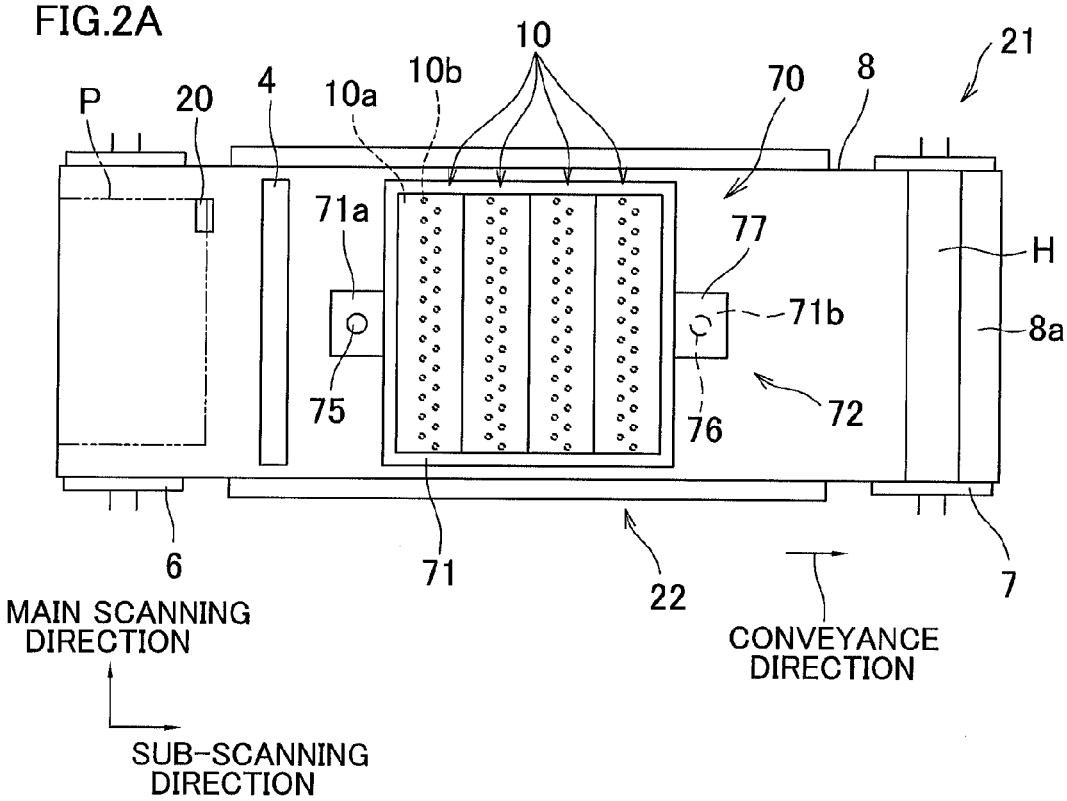
Figure 2B:
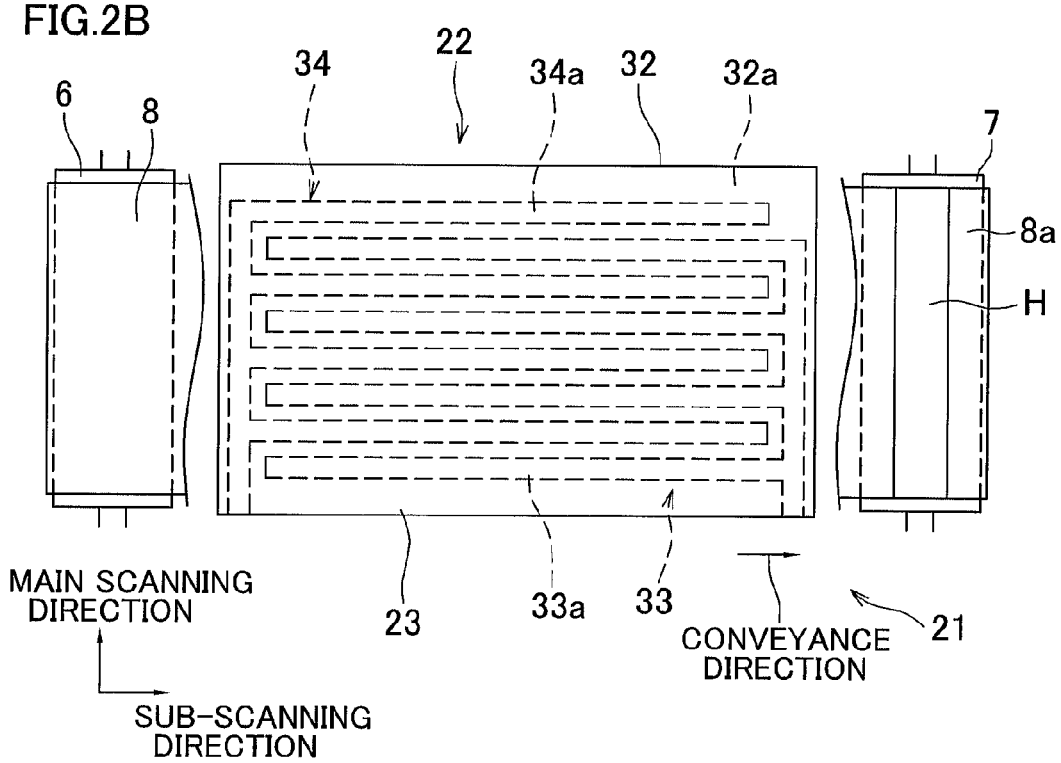
FIG. 2B is a schematic plan view of the conveying unit.

The attracting platen 22 includes, as shown in FIG. 1, FIG. 2A, and FIG. 2B, a plate-shaped base 32 made of an insulating material, two electrodes 33 and 34 adhered to the upper surface 32*a* of the base 32, and a protective film 23 adhering to the upper surface 32*a* to entirely cover the electrodes 33 and 34. The attracting platen 22 is arranged to face the four heads 10 across the conveyance belt 8 so as to support the upper loop portion of the conveyance belt 8 from the inside. The electrodes 33 and 34 form a comb shape such that a plurality of long portions 33*a* and 34*a* extending along the sub-scanning directions are connected with one another at their proximal ends. The long portions 33*a* and the long portions 34*a* are alternately provided in the main scanning directions. The electrodes 33 and 34 are connected to a power source 36 (sec FIG. 6) which is provided in the chassis 1*a*. This power source 36 is controlled by the control unit 1*p*. The attracting platen 22 and the power source 36 constitute a attracting unit which attracts a sheet P onto the outer surface 8*a* of the conveyance belt 8.

The protective film 23 is made of a material such as polyimide fluororesin and has a volume resistivity of about 108 to 1014 ohm centimeters. Alternatively, the protective film 23 may be made of another material having a similar volume resistivity.

The nipping roller 1 made of a conductive material is provided at the upstream end of the attracting platen 22 in the conveyance direction and faces the long portions 33*a* and 34*a* of the electrodes 33 and 34. The nipping roller 4 presses a sheet P sent out from the sheet supply unit 1*b* onto the outer surface 8*a* of the conveyance belt 8.

With the arrangement above, the conveyance belt 8 is moved by rotating the belt roller 7 clockwise in FIG. 1 under the control of the control unit 1*p*. As the conveyance belt 8 is moved, the belt roller 6 and the nipping roller 4 are rotated. While a sheet P is conveyed on the conveyance belt 8, different electric potentials are applied to the two electrodes 33 and 34 under the control of the control unit 1*p*, respectively. (For example, a positive (e.g. 1 kV) or negative electric potential is applied to the electrode 33 whereas a ground potential is applied to the electrode 34.)

When the electric potentials are applied to the two electrodes 33 and 34 in this manner, the nipping roller 4 is conductive and hence, at the portion facing the nipping roller 4, an electric current flows from the electrode 33 (long portion 33*a*) to the nipping roller 4 via the protective film 23, the conveyance belt 8, and the sheet P, and also flows from the nipping roller 4 to the electrode 34 (long portion 34*a*) via the sheet P, the conveyance belt 8, and the protective film 23. As a result, a positive or negative electric charge is generated at a portion of the conveyance belt 8 which faces the sheet P, and an electric charge whose polarity is opposite to that electric charge is induced at the surface of the sheet P facing the conveyance belt 8. As these opposing electric charges attract each other, the attracting force attracting the sheet P onto the conveyance belt 8 is generated.

In the meanwhile, at a portion not facing the nipping roller 4, an electric current flows from the electrode 33 (long portion 33*a*) to the sheet P via the protective film 23 and the conveyance belt 8, and also flows from the sheet P to the electrode 34 (long portion 34*a*) via the conveyance belt 8 and the protective film 23. Since the resistance of the sheet P in this case is significantly higher than that of the nipping roller 4, the overall resistance of this path is higher than the overall resistance of the path which passes through the nipping roller 4. For this reason, even though the same electric potentials are applied to the respective electrodes 33 and 34, the electric current on the path passing through the nipping roller 4 is larger than that of the other path. The Johnsen-Rahbek force between the conveyance belt 8 and the sheet P, i.e. the attracting force generated by the attracting platen 22, increases as the current flowing between the conveyance belt 8 and the sheet P increases. In other words, as the electric current is increased, the attracting force at the portion facing the nipping roller 4 becomes larger than in the remaining portions.

As such the sheet P sent out from the sheet supply unit 1*b* is attracted to the outer surface 8*a* at the portion where the attracting force is significantly large (i.e. at the portion facing the nipping roller 4). The sheet P is conveyed while being supported and attracted by the other portions (i.e. the portions not facing the nipping roller 4), as the conveyance belt 8 moves in the travel direction. When the sheet P conveyed while being attracted onto the outer surface 8*a* of the conveyance belt 8 passes through the region immediately below each head 10, i.e. passes through the region facing each ejection surface 10*a*, the control unit 1*p* controls each head 10 so that the head 10 discharges the ink of the corresponding color onto the sheet P. As a result, a desired color image is formed on the sheet P. The peeling plate 5 is arranged to face the belt roller 7. This peeling plate 5 peels the sheet P off from the outer surface 8*a* and sends the same toward the downstream of the conveyance direction.

The wiping mechanism 60 includes a main wiper 41, a sub wiper 51, and a wiper cleaner 45. The components of the wiping mechanism 60 are arranged to face the outer circumferential surface of the lower loop portion of the conveyance belt 8. Inside the conveyance belt 8, a platen 9 is provided to face the wipers 41 and 51 across the conveyance belt 8 and to support the lower loop portion of the conveyance belt 8 from the inside. When the wipers 41 and 51 remove foreign matters, the platen 9 prevents the conveyance belt 8 from being warped by the pressures exerted by the wipers 41 and 51. This equalizes the contact pressures of the wipers 41 and 51 onto the conveyance belt 8, thereby ensuring a good wiping performance. The details of the structure of the wiping mechanism 60 will be given later with reference to FIG. 3 and FIG. 4A to FIG. 4G.

Each head 10 is, as shown in FIG. 1 and FIG. 2A, a substantially rectangular parallelepiped line-type head which is long in the main scanning directions. The lower surface of each head 10 is the ejection surface 10*a* where a plurality of ejection openings 10*b* are formed. For recording, i.e. for image formation, the ejection surfaces 10*a* of the respective heads 10 eject black, magenta, cyan, and yellow inks. These four heads 10 are aligned in the sub-scanning directions. Each of these heads 10 is provided so that the ejection surface 10*a* faces the outer surface 8*a* of the upper loop portion of the conveyance belt 8 and a gap suitable for recording is formed between the ejection surface 10*a* and the outer surface 8*a*.

The guide unit includes an upstream guide unit provided between the conveying unit 21 and the sheet supply unit 1*b* and a downstream guide unit provided between the conveying unit 21 and the area 31. The upstream guide unit includes two guides 27*a* and 27*b* and a pair of forwarding rollers 26. The downstream guide unit includes two guides 29*a* and 29*b* and two pairs of forwarding rollers 28.

In the space B, the sheet supply unit 1*b* is detachably attached to the chassis 1*a*. The sheet supply unit 1*b* has a sheet feeding tray 24 and a pickup roller 25. The sheet feeding tray 24 is an open-top box and in which plural types of sheets P having different sizes cam be stacked and stored. The pickup roller 25 sends out the topmost sheet P in the sheet feeding tray 24 and supplies the sheet P to the upstream guide unit.

As such, in the spaces A and B, a conveying path is formed from the sheet supply unit 1*b* to the area 31 via the conveying unit 21. Based on a recording instruction supplied from an external apparatus, the control unit 1*p* drives, in accordance with a predetermined sequence, a pickup motor 125 (see FIG. 6) connected to the pickup roller 25, a feed motor 127 (see FIG. 6) connected to the forwarding rollers of each guide unit, and a conveyance motor 121 (see FIG. 6). The sheet P sent out from the sheet feeding tray 24 is supplied to the conveying unit 21 by the forwarding rollers 26. In so doing, the control unit 1*p* controls the power source 36 so as to cause the sheet P supplied to the conveyance belt 8 to be attracted onto the outer surface 8*a*. When the sheet P passes through the region immediately below each head 10 in the conveyance direction, the control unit 1*a* controls the heads 10 so that inks having corresponding colors are ejected from the respective heads 10 and a color image is formed on the sheet P. The ejection of ink is carried out based on a detection signal from the sheet sensor 20. The sheet sensor 20 is, as shown in FIG. 2A, provided around one end of the conveyance belt 8 in the sub-scanning directions, and hence it can detect the leading edge of the conveyed, sheet P. After passing through the regions immediately below the four heads 10, respectively, the sheet P is peeled off by the peeling plate 5. The sheet P is then conveyed upward by the two forwarding rollers 28 and, is ejected to the area 31 through an upper opening 30. On the downstream in the conveyance direction of the peeling plate 5, a sheet sensor 81 is provided. The control unit 1.*p* determines that paper jam has occurred, when the sheet P conveyed in the conveyance direction is not detected by the sheet sensor 81 after a predetermined time has passed from the detection of the sheet P by the sheet sensor 20. The sheet sensor 81 is not necessarily provided downstream of the peeling plate 5 in the conveyance direction. The sheet sensor 81 is only required to be provided downstream of the heads 10.

In the space C, a cartridge unit 1*c* is detachably attached to the chassis 1*a*. This cartridge unit 1*c* includes a tray 35 and four cartridges 39 aligned in the tray 35. Each cartridge 39 stores magenta, cyan, yellow, or black ink. The cartridge 39 supplies the ink to the corresponding head 10 via an unillustrated tube. The inks in the present embodiment are aqueous ink. More specifically, such aqueous ink includes water, a moistening agent, a penetrant, and a colorant. The moistening agent is either glycerine or diethylene glycol. The moistening agent restrains ink drying, i.e. the reduction in the moisture in the ink. In this regard, however since the concentration of the moistening agent is high in the thickened ink which is dry and has a reduced amount of moisture, the moistening agent adversely functions as a moisture absorbent absorbing moisture from the surrounding ink. In other words, because of the hygroscopic properly of the moistening agent, the thickened ink absorbs moisture from the surrounding non-dry ink.

Figure 3:
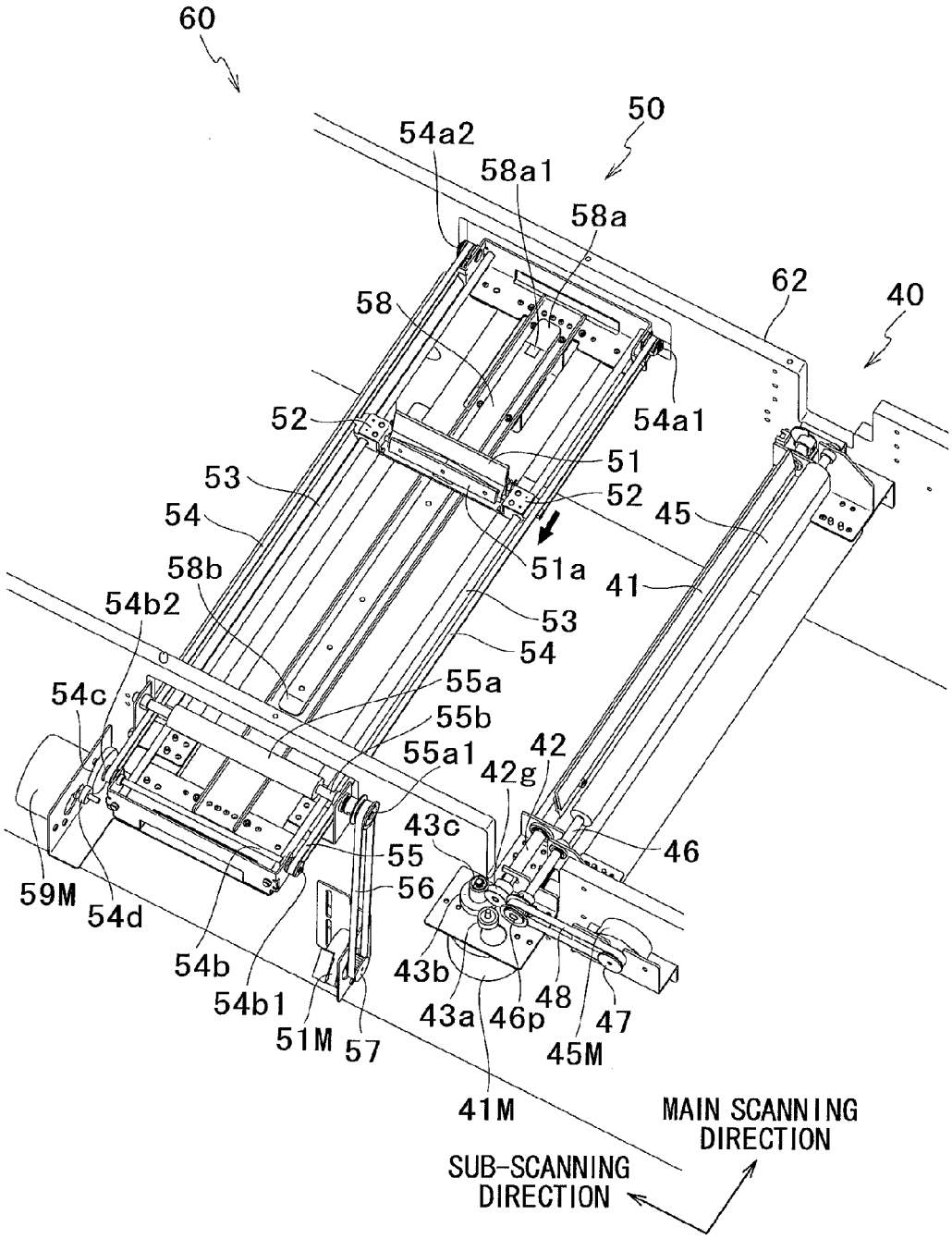
FIG. 3 is a schematic perspective view of the wiping mechanism shown in FIG. 1.

Now, the structure of the wiping mechanism 60 will be described with reference to FIG. 3 and FIG. 4A to FIG. 4G. As shown in FIG. 3, the wiping mechanism 60 includes a main wiping mechanism 40 and a sub wiping mechanism 50.

The main wiping mechanism 40 includes a main wiper 41 and a wiper cleaner 45. The main wiper 41 is used for later-described first wiper drive. This main wiper 41 is a blade made of an elastic material such as rubber, and is long in the main scanning directions. The proximal end, i.e. the lower end of the main wiper 41 is fixed to the circumferential surface of the shaft 42. The shaft 42 extends along the main scanning directions and is swingably supported by a frame 62. As the shaft 42 rotates, the main wiper 41 swings about the shaft 42. The frame 62 is fixed to the chassis 1*a* (see FIG. 1).

The main wiping mechanism 40 includes, as components for rotating the shaft 42, a gear 43*a* fixed to the output shaft of a motor 41M, a gear 43*b* engaged with the gear 43*a*, and a worm gear 43*c* rotated in accordance with the rotation of the gear 43*b*. At one end of the shaft 42, a worm wheel 42*g* is provided to be engaged with the circumferential surface of the worm gear 43*c*. As the gears 43*a*, 431), and 43*c* are rotated by the motor 41M, the worm wheel 42*g* is rotated. Because of the above, the shaft 42 rotates about its shaft extending along the main scanning directions, with the result that the tilt angle of the main wiper 41 is changed with respect to the horizontal plane.

The tilt angle of the main wiper 41 is controlled by the control unit 1*p* so that the leading end part of the main wiper 41 contacts and is warped by the outer surface 8*a* of the conveyance belt 8 during the first wiper drive whereas the leading end of the main wiper 41 is distanced from the outer surface 8*a* of the conveyance belt 8 when the first wiper drive is not carried out. In particular, the tilt angle of the main wiper 41 is controlled by the control unit 1*p* so that, when the first wiper drive is not carried out, the leading end of the main wiper 41 contacts the wiper cleaner 45 during later-described wiper cleaning whereas the leading end of the main wiper 41 is distanced from the wiper cleaner 45 when the wiper cleaning is not carried out.

The main wiper 41 is slightly longer in the main scanning directions than the width of the conveyance belt 8 and is formed across the entire width of the conveyance belt 8. In other words, the main wiper 41 is provided so that its center in the main scanning directions corresponds to the center of the conveyance belt 8 in the width directions and in a plan view the main wiper 41 protrudes from the both sides of the conveyance belt 8 in the width directions. The leading edge of the main wiper 41 contacts the entire width of the conveyance belt 8 during the first wiping. As a result of the first wiper drive, most of the foreign matters are removed from the region of the outer surface 8*a* which region is wiped by the main wiper 41. This prevents the foreign matters adhering to the outer surface 8*a* from adhering to the back side of the sheet P on the conveyance belt 8 and avoids a problem that the conveyance belt cannot convey the sheet P as the foreign matters adhering to the outer surface 8*a* lower the force of attracting the sheet P onto the conveyance belt 8.

The wiper cleaner 45 used for the wiper cleaning is constituted by, for example, an absorbent such as sponge. The wiper cleaner 45 is tube-shaped and extends in the main scanning directions, and pivoted at the shaft 46. The shaft 46 extends along the main scanning directions and rotatably supported by the frame 62. As the shaft 46 rotates, the wiper cleaner 46 rotates.

The main wiping mechanism 40 includes, as components used for rotating the shaft 46, a pulley 47 fixed to the output shaft of a motor 45M, a pulley 46*p* fixed to one end of the shaft 46, and a belt 48 stretched between the pulley 46*p* and the pulley 47. As the pulley 47 is rotated by the motor 45M, the belt 48 moves and the pulley 46*p* rotates. As a result, the shaft 46 rotates with the wiper cleaner 45.

The sub wiping mechanism 50 includes a sub wiper 51 and a sub wiper cleaner 55*a*, and is provided downstream of the main wiping mechanism 40 in the travel direction of the conveyance belt 8. The sub wiper 51 is used for later-described second wiper drive. The sub wiper 51 is a blade made of an elastic material such as rubber and extends in the sub-scanning directions. The length of the sub wiper 51 in the sub-scanning directions is longer than the length of the preliminary ejection region H in the sub-scanning directions. The proximal end, i.e. the lower end of the sub wiper 51 is fixed to a wiper supporter 51*a*. This wiper supporter 51*a* extends in the sub-scanning directions. At the both ends of the wiper supporter 51*a* in the sub-scanning directions, sliders 52 are provided, respectively. The wiper supporter 51*a* is supported by the pair of sliders 52 so as to be swingable about the axis along the sub-scanning directions. As the wiper supporter 51*a* swings, the sub wiper 51 also swings. The sub wiper 51 and the wiper supporter 51*a* are biased clockwise in FIG. 1A by an unillustrated biasing component such as a spring. The pair of sliders 52 are supported by a pair of bars 53 to be movable in the main scanning directions. The pair of bars 53 extend in the main scanning directions and are inserted into holes penetrating the sliders 52. As the pair of sliders 52 move in the main scanning directions, the sub wiper 51 also moves in the main scanning directions.

The sub wiping mechanism 50 includes, as components for moving the sub wiper 51 in the main scanning directions, a pair of endless belts 54, pulleys 54*a*1 and 54*a*2 around which the pair of belts 54 travel, a roller 54*b* around which the pair of belts 54 travel, and pulleys 54*b*1 and 54*b*2 provided at the respective ends of the roller 54*b*. On the lower loop portion of each belt 54, a single slider 52 is fixed. The sub wiping mechanism 50 further includes a gear 54*c* which rotates together with the pulley 54*b*2 and a gear 54*d* which is engaged with the gear 54*c* and fixed to the output shaft of the motor 59M. As the gears 54*c* and 54*d* are rotated by the motor 59M, the pulley 54*b*2 rotates. Then the rotation of the pulley 54*b*2 causes the roller 54*b* to rotate, with the result that the pair of belts 54 move. The sliders 52 therefore move in the main scanning directions while supporting the wiper supporter 51*a*.

Figure 4A:
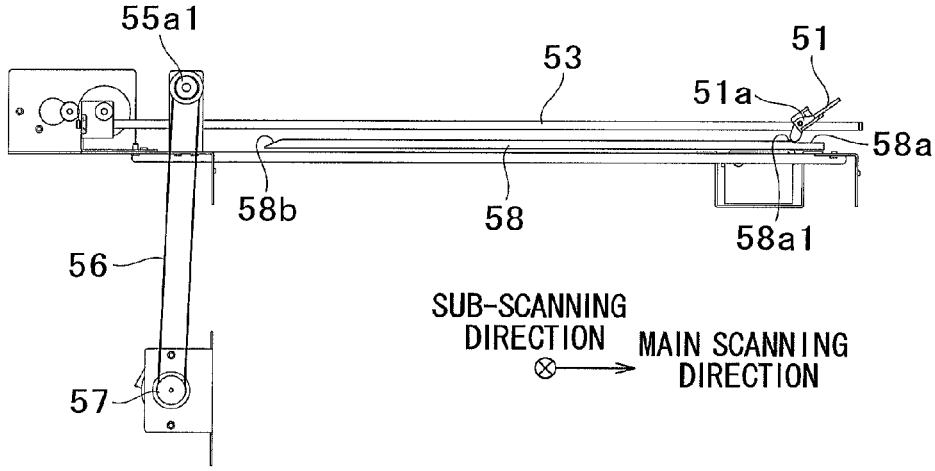
FIG. 4A to FIG. 4G illustrate the operation of a sub wiper.

The sub wiping mechanism 50 also includes a plate 58 below the wiper supporter 51*a*, as a component for rotating the sub wiper 51. This plate 58 is long in the main scanning directions and is in parallel to the horizontal plane. As shown in FIG. 4A, while the sub wiper 51 is moving in the main scanning direction, the lower edge of the wiper supporter 51*a* slides on the upper surface of the plate 58.

The upper surface of the plate 58 is flat except at the both ends in the main scanning directions. At one end of the plate 58 in the main scanning directions (i.e. at the end on the upstream of the movement direction (indicated by the arrow in FIG. 3) of the sub wiper 51 during the wiping operation), a lowered part 58*a* is provided. At the other end of the plate 58 is provided a slope 58*b*. The lowered part 58*a* is lower than a part of the upper surface of the plate 58 which part is different from the both end parts of the upper surface in the main scanning directions. On the upper surface of the plate 58, an ear portion 58*a*1 is provided at the border between the lowered part 58*a* and the remaining part of the plate 58. The ear portion 58*a*1 selectively takes, as discussed later, a protruding position at which it protrudes from the upper surface of the plate 58 and a retracted position at which it does not protrude from the upper surface of the plate 58.

The sub wiper cleaner 55*a* cleans the sub wiper 51 after the second wiper drive and is made of an absorbent such as sponge. The sub wiper cleaner 55*a* is tube-shaped and extends along the sub-scanning directions, and is pivoted at the shaft 55*b*. The shaft 55*b* extends in the sub-scanning directions and is rotatably supported by the frame 62. As the shaft 55*b* rotates, the sub wiper cleaner 55*a* also rotates.

The sub wiping mechanism 50 includes, as components for rotating the shaft 55*b*, a pulley 57 fixed to the output shaft of a motor 51M, a pulley 55*a*1 fixed to one end of the shaft 55*b*, and a belt 56 stretched between the pulley 57 and the pulley 55*a*1. As the pulley 57 is rotated by the motor 51M, the belt 56 moves and the pulley 55*a*1 rotates. Consequently, the shaft 55*b* rotates with the sub wiper cleaner 55*a* about the axis extending in the sub-scanning directions. The ear portion 58*a*1 is arranged to be movable between a protruding position at which it protrudes upward from the upper surface of the plate 58 except the both edges of the upper surface in the main scanning directions and a retracted position at which it is retracted into the plate 58 so as to be flush with the upper surface of the plate 58 except the both edges of the upper surface in the main scanning directions. The ear portion 38*a*1 is biased upward by an unillustrated mechanism and is therefore at the protruding position when no external force is exerted thereto.

Now, the operation of the sub wiper 51 during the second wiper drive will be described. The second wiper drive is an operation such that the sub wiper 51 moves along the main scanning directions while contacting the outer surface 8*a* of the conveyance belt 8 to remove foreign matters from the outer surface 8*a*.

When the second wiper drive is not carried out, as shown in FIG. 4A, the sub wiper 51 is at a home position at one end of the plate 58 in the main scanning directions. At this home position, the sub wiper 51 vertically faces the outer surface 8*a* of the conveyance belt 8 and is stationary at a tilt angle with which the leading end thereof does not contact the outer surface 8*a*. At this position, as shown in FIG. 4B, the lower end 51*a*1 of the wiper supporter 51*a* is in contact with the right side of the ear portion 58*a*1, i.e. in contact with the right inclined plane of the ear portion 58*a*1 facing the lowered part 58*a*.

Figure 4B:
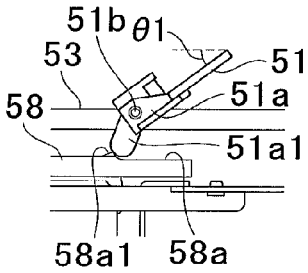
Figure 4C:
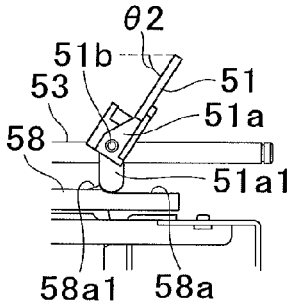
Figure 4D:
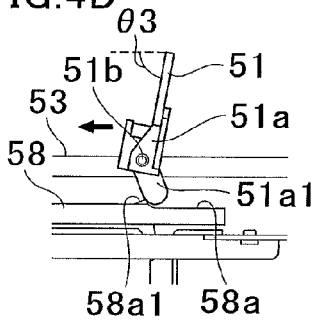
Figure 4E:
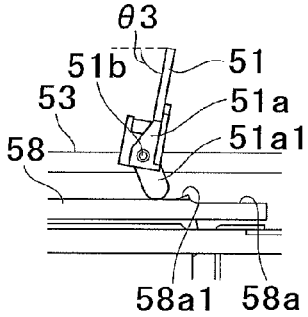
Figure 4F:
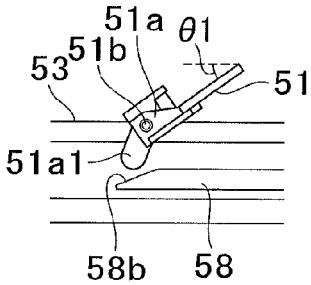

When the slider 52 starts to move in a main scanning direction in response to the drive of the motor 59M in the second wiper drive, as serially shown in FIG. 4B, FIG. 4C, and FIG. 4D, the lower end 51*a*1 swings anticlockwise while contacting the right inclined plane of the ear portion 58*a*1. This causes the sub wiper 51 to swing with the wiper supporter 51*a* about the shaft 51*b* which extends along the sub-scanning directions, against the biasing force exerted by the biasing component, and hence the tilt angle of the sub wiper 51 with respect to the horizontal plane gets large (θ1 in FIG. 48, θ2 (>θ1) in FIG. 4C, and θ3 (>θ2) in FIG. 4D). When the tilt angle shown in FIG. 4D reaches θ3, the leading end of the sub wiper 51 contacts the outer surface 8*a* of the conveyance belt 8. As the sliders 52 further move in the main scanning direction, the ear portion 58*a*1 is pushed downward by the lower end 51*a*1, with the result that the ear portion 58*a*1 takes the retracted position. As the sliders 52 further move in the main scanning direction, as shown in FIG. 4E, the lower end 51*a*1 passes through the space above the ear portion 58*a*1. In this state, the sub wiper 51 and the wiper supporter 51*a* are receiving the biasing force exerted by the biasing component (in the direction of changing the tilt angle of the sub wiper 51 from θ3 to θ1). However, since the lower end 51*a*1 is supported by the surface of the plate 58, the tilt angle of the sub wiper 51 is maintained at θ3. Then the sub wiper 51 moves in the main scanning direction while keeping its leading end to contact the outer surface 8*a*. When the sub wiper 51 reaches the other end of the plate 58 in the main scanning directions, the lower end 51*a*1 faces the slope 58*b*. In this state, as shown in FIG. 4F, the lower end 51*a*1 is distanced from the upper surface (slope 58*b*) of the plate 58. As such, the sub wiper 51 rotates clockwise about the shaft 51*b* together with the wiper supporter 51*a* on account of the biasing force of the biasing component, with the result that the tilt angle of the sub wiper 51 returns from θ3 to θ1 and the leading end of the sub wiper 51 is distanced from the outer surface 8*a* of the conveyance belt 8.

Figure 4G:
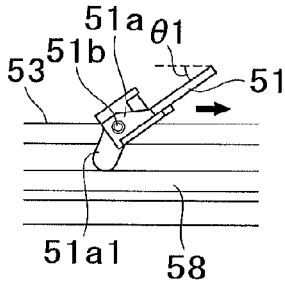

After the second wiper drive, the sub wiper 51 moves to a position where its leading end contacts the sub wiper cleaner 55*a*, while keeping the leading end to be distanced from the outer surface 8*a* and maintaining the tilt angle at θ1. After the leading end of the sub wiper 51 is cleaned, by the sub wiper cleaner 55*a*, as shown in FIG. 4G, the sub wiper 51 moves in the main scanning direction toward the home position while keeping the tilt angle at θ1. At around the home position, the lower end 51*a*1 contacts the left inclined plane of the ear portion 58*a*1 which does not face the lowered part 58*a*, and passes through the ear portion 58*a*1 while changing the position of the ear portion 58*a*1 to the retracted position. Thereafter, the sub wiper 51 stops at the home position while maintaining its tilt angle at θ1 and keeping its leading end to be distanced from the outer surface 8*a*.

When the tilt angle is at θ3, the leading end part of the sub wiper 51 contacts and is warped by the outer surface 8*a* of the conveyance belt 8. The pressure of the sub wiper 51 onto the outer surface 8*a* of the conveyance belt 8 when the tilt angle is at θ3 is lower than the pressure of the main wiper 41 onto the outer surface 8*a* during the first wiper drive. In the present embodiment, the distance between the shaft 51*b* which is the center of rotation of the sub wiper 51 and the outer surface 8*a* of the conveyance belt 8 is longer than the distance between the shaft 42 which is the center of rotation of the main wiper 41 and the outer surface 8*a* of the conveyance belt 8. It is noted that the distance between the shaft 51*b* and the outer surface 8*a* of the conveyance belt 8 may be identical with the distance between the shaft 42 and the outer surface 8*a* of the conveyance belt 8. In such a case, the tilt angle θ3 of the sub wiper 51 during the second viper drive may be smaller than the tilt angle of the main wiper 41 during the first wiper drive.

Since the pressure of the sub wiper 51 is lower than the pressure of the main wiper 41 as described above, the wiping capability of the sub wiper 51 to wipe foreign matters from the outer surface 8*a* is lower than the wiping capability of the main wiper 41, and hence the frictional force between the sub wiper 51 and the outer surface 8*a* is small during the second wiper drive. This restrains, in the second wiper drive, the conveyance belt 8 from being displaced in the main scanning directions on account of the movement of the sub wiper 51 in the main scanning directions. Since the displacement of the conveyance belt 8 in the main scanning directions is restrained, it is possible to restrain the deterioration of the conveying accuracy of the conveyance belt. Furthermore, the main wiper 41 exerting a high pressure certainly gathers, as described later, foreign matters to a small area, without allowing the sub wiper 51 exerting a low pressure to displace the conveyance belt 8.

It is noted that, even if the pressure of the sub wiper 51 is small, a desired amount of foreign matters are removed from the outer surface 8*a* of the conveyance belt 8 because the sub wiper 51 contacts the outer surface 8*a*. In other words, removed by the sub wiper 51 are the foreign matters remaining at around the area of the outer surface 8*a* from which area the main wiper 41 has been detached and gathered to the small area by the main wiper 41 or the foreign matters adhering to the highly liquid repellent preliminary ejection region H, and few foreign matters remain after the wiping by the sub wiper 51. This prevents the foreign matters remaining on the outer surface 8*a* even after the wiping of the sub wiper 51 from adhering to the back side of the sheet P conveyed by the conveyance belt 8 and prevents the attracting force of the conveyance belt 8 for attracting the sheet P from being lowered by the foreign matters adhering to the outer surface 8*a*, thereby preventing the conveyance belt 8 from becoming unable to convey the sheet P.

The components (e.g. the belt 54) by which the sub wiper 51 is moved in the main scanning directions are provided across the entire width of the conveyance belt 8. The sub wiper 51 therefore moves, during the second wiper drive, from the one end to the other end of the conveyance belt 8 in the width direction while keeping the leading end part to contact and to be warped by the outer surface 8*a* of the conveyance belt 8, so as to remove the foreign matters across the entire width of the conveyance belt 8. The foreign matters removed by the wipers 41 and 51 are received by an unillustrated receiver below the wipers 41 and 51.

Figure 5A:
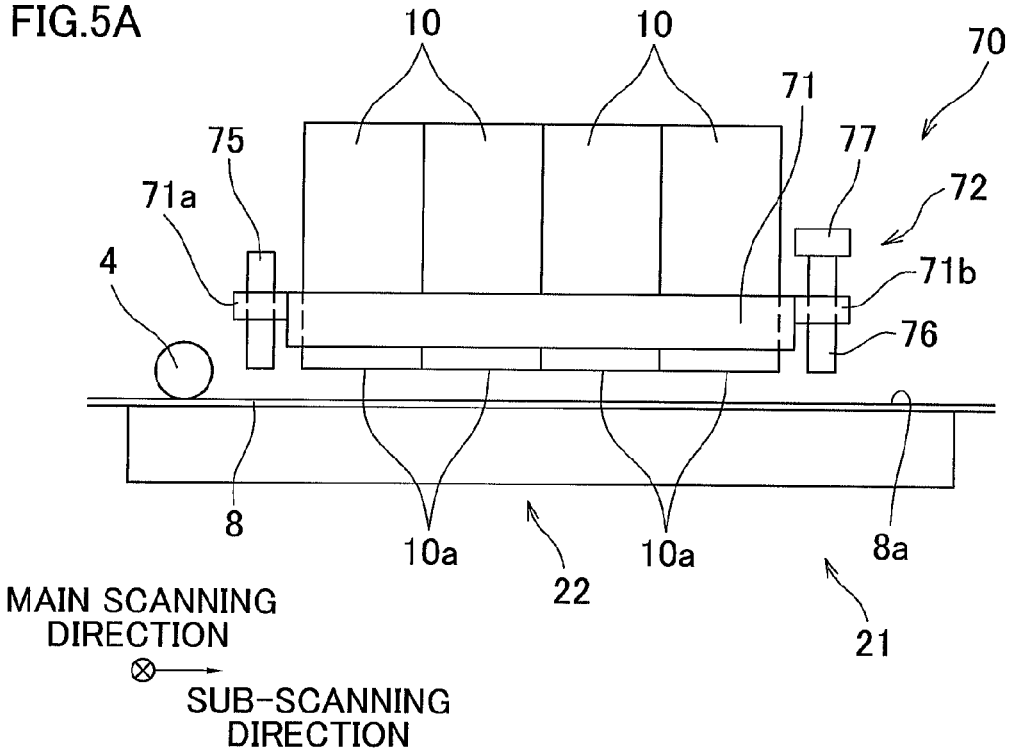
FIG. 5A and FIG. 5B illustrate the operation of the capping mechanism shown in FIG. 1.
Figure 5B:
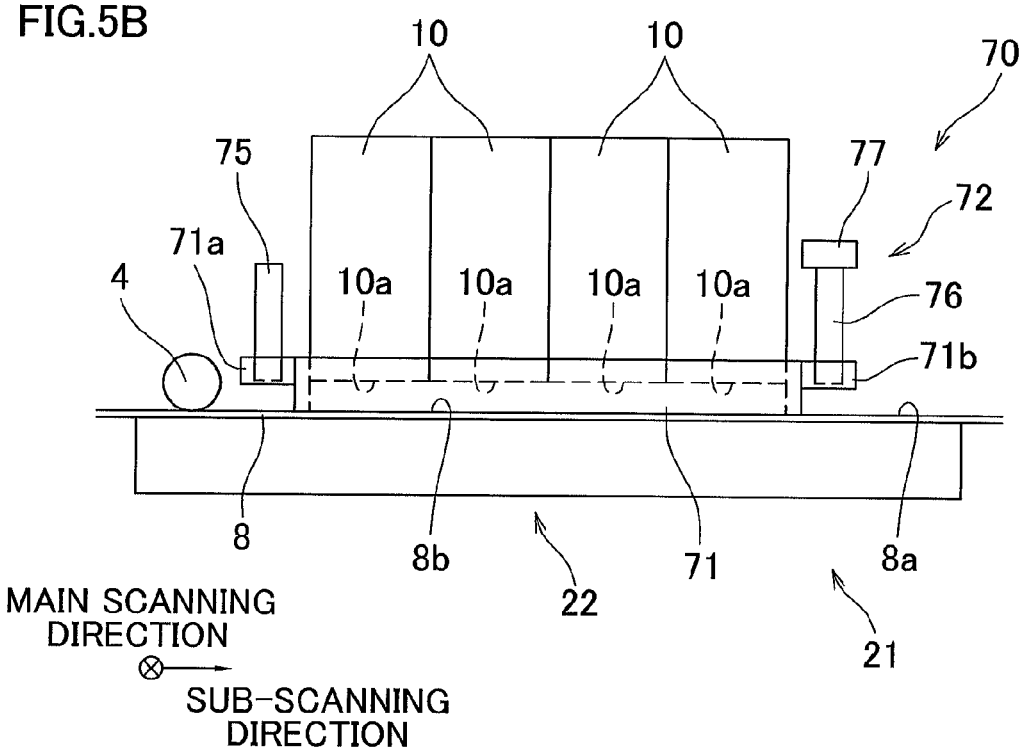

The capping mechanism 70 includes, as shown in FIG. 2A, FIG. 5A, and FIG. 5B, a annular component 71 circumscribing the four heads 10 and a moving mechanism 72 which vertically moves the annular component 71. The annular component 71 circumscribes the four heads 10 and contacts the side faces of the assembly of the four heads 11) only at around the upper end of the inner circumferential surface of the component 71. The lower end of the annular component 71 is thrilled by an elastic material such as rubber.

The moving mechanism 72 includes two flanges 71*a* and 71*b* fixed to the side face of the annular component 71, a guide 75 which slidably supports the flange 71*a* in vertical directions, a shaft 76 having a male-threaded outer circumferential surface, and a motor 77 which rotates the shaft 76 under the control of the control unit 1*p*. The guide 75 is fixed to the chassis 1*a* and passes through a hole formed at the center of the flange 71*a*. The shaft 76 is connected to the motor 77 fixed to the chassis 1*a* and is screwed into a screw hole which is formed at the center of the flange 71*b* and has a female-threaded inner circumferential surface.

According to this arrangement, when the shaft 76 rotates forward under the control of the control unit 1*p*, the annular component 71 moves from a retracted position (shown in FIG. 5A) where the lower end of the annular component 71 is distanced from the conveyance belt 8 to a contact position (shown in FIG. 5B) where the lower end of the annular component 71 contacts the outer surface 8*a* of the conveyance belt 8. The retracted position is a position where the ejection surfaces 10*a*, the annular component 71, and the outer surface 8*a* of the conveyance belt 8 do not form a closed space and where the ejection surfaces 10*a* are not covered by the annular component 71 and the outer surface 8*a* of the conveyance belt 8. On the other hand, the contact position is a position where the ejection surfaces 10*a*, the annular component 71, and the outer surface 8*a* of the conveyance belt 8 form a closed space and where the ejection surfaces 10*a* are covered by the annular component 71 and the outer surface 8*a* of the conveyance belt 8. At this position, since the upper end part of the annular component 71 contacts the side faces of the assembly of the four heads 10, the ejection surfaces 10*a*, the outer surface 8*a* of the conveyance belt 8, and the annular component 71 form a closed space. The four ejection surfaces 10*a* are entirely covered by the annular component 71 and the outer surface 8*a* of the conveyance belt 8, i.e. these ejection surfaces 10*a* are capped and sealed. This makes it possible to restrain the thickening of the ink around the ejection openings 10*b* of the heads 10. On the other hand, when the shaft 76 rotates backward under the control of the control unit 1*p*, the annular component 71 moves from the contact position to the retracted position.

Figure 6:
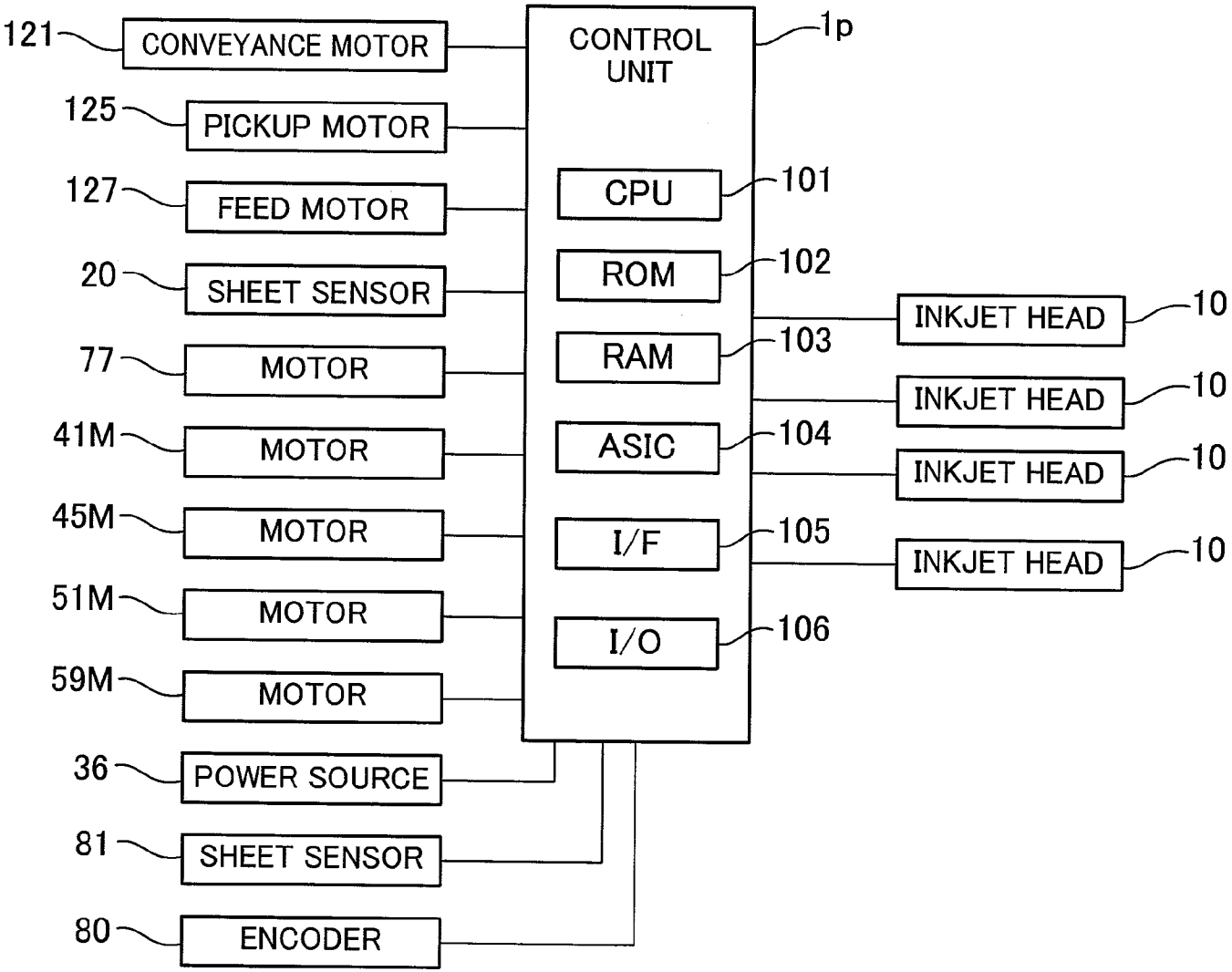
FIG. 6 is a block diagram of the electric configuration of the printer.
Figure 7:
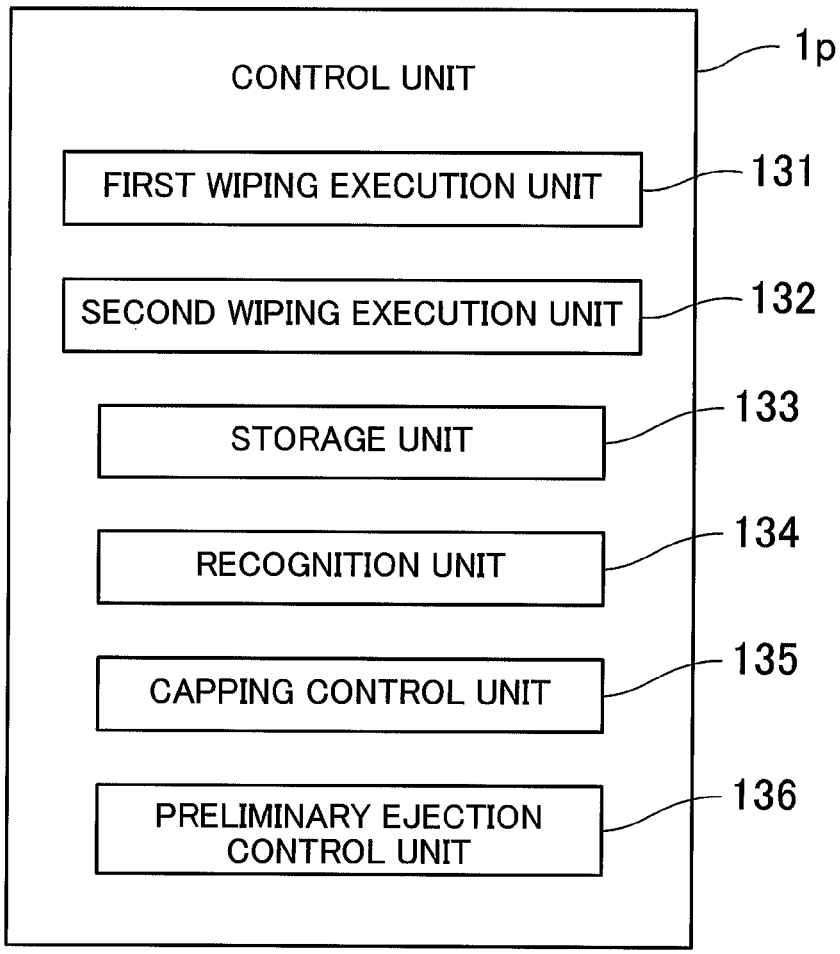
FIG. 7 is a schematic block diagram of the control unit shown in FIG. 1.

Now referring to FIG. 6 and FIG. 7, the electric configuration of the printer 1 will be described. The control unit 1*p* includes, as shown in FIG. 6, a ROM (Read Only Memory) 102, a RAM (Random Access Memory) 103, an ASIC (Application Specific Integrated Circuit) 104, an I/F (Interface) 105, and an I/O port (Input/Output Port) 106, in addition to a CPU (Central Processing Unit) 101 which is a processing unit. The ROM 102 stores programs executed by the CPU 101 and various types of data. The RAM 103 temporarily stores data (e.g. image data regarding an image to be printed on a sheet P) required for running a program. The ASIC 104 performs conversion of image data (e.g. signal processing and image processing). The I/F 105 performs data exchange with an external apparatus. The I/O port 106 is responsible for input and output of detection signals from/to various sensors.

The control unit 1*p* is connected to the motors 121, 125, 127, 41M, 45M, 51M, 59M, and 77, the sheet sensor 20, the power source 36, and the control substrate of each head 10. The control unit 1*p* has, as shown in FIG. 7, functional parts such as a first wiping execution unit 131, a second wiping execution unit 132, a storage unit 133, a recognition unit 134, a capping control unit 135, and a preliminary ejection control unit 136, which are constructed by the above-described hardware.

The first wiping execution unit 131 controls the motor 41M and the conveyance motor 121 to carry out the first wiper drive such that the leading end of the main wiper 41 distanced from the outer surface 8*a* is moved to contact the outer surface 8*a* and the main wiper 41 and the outer surface 8*a* are relatively moved in the conveyance direction to wipe out the foreign matters on the outer surface 8*a*. The first wiper drive of the present embodiment includes a preliminary wiping operation (first wiping operation) to wipe the outer surface 8*a* to form a later-described first region G before the capping and a post wiping operation (second wiping operation) to wipe a later-described second region F during the capping.

The second wiping execution unit 132 controls the motor 59M and the conveyance motor 121 to perform the second wiper drive such that the leading end of the sub wiper 51 distanced from the outer surface 8*a* is moved to contact the outer surface 8*a* and the sub wiper 51 and the outer surface 8*a* are relatively moved in the main scanning direction to wipe the foreign matters on the outer surface 8*a*.

The storage unit 133 stores the activity log of the printer 1 from the power on to the power off of the power source of the printer 1. The activity log stored in the storage unit 133 is reset when a series of operations are carried out in response to a later-described maintenance instruction for the capping.

The recognition unit 134 recognizes the positions of the first region G and the second region F on the outer surface 8*a*, based on the activity log stored in the storage unit 133. In other words, based on the activity log, the recognition unit 134 recognizes, as the first region (3, a region which is not smaller in size than an enclosed range 8*b* (see FIG. 5B) of the outer surface 8*a* which range is enclosed by the annular component 71 at the contact position and is a region where an amount of adhering ink in an arbitrary range which is in the first region and is identical in size with the enclosed range is not larger than a predetermined amount. On the other hand, based on the activity log, the recognition unit 134 recognizes, as the second region F, a region which is not smaller in size than the enclosed, range 8*b* of the outer surface 8*a* and is a region where an amount of adhering ink in an arbitrary range which is in the second region and is identical in size with the enclosed range is larger than the predetermined amount. In regard to the first region G, it is assumed that an amount of adhering ink is not larger than the predetermined amount wherever in the first region G the selected arbitrary range identical in size with the enclosed range 8*b* might be. In the meanwhile, in the second region F, it is assumed that an amount of adhering ink is larger than the predetermined amount wherever in the second region F the selected arbitrary range identical in size with the enclosed range 8*b* might be.

For example, the activity log stored in the storage unit 133 indicates that an operation involving adherence of ink to the entirety of the outer surface 8*a* of the conveyance belt 8 (e.g. a recording operation with which ink mist involving an adhering ink amount larger than the predetermined amount seems to occur, paper jam, and purging) has been carried out by the printer 1, the recognition unit 134 recognizes that the predetermined amount or more of ink adheres to the entirety of the outer surface 8*a* of the conveyance belt 8. In short, the entirety of the outer surface 8*a* is recognized as the second region F. It is noted that the case where a recording operation with which ink mist involving an adhering ink amount larger than the predetermined amount seems to occur has been carried out by the printer 1 corresponds to a case where the cumulative ink amount ejected from the heads 10 after a series of operations are carried out in response to the later-described maintenance instruction for the capping, i.e. after the wiping of the outer surface 8*a*, exceeds a threshold. In this case, the recognition unit 134 recognizes that ink mist adheres to the entirety of the outer surface 8*a* of the conveyance belt 8 and the amount of adhering ink exceeds the predetermined amount. When paper jam occurs, it is assumed that a large amount of ink adheres to the entirety of the outer surface 8*a* because ink is ejected from the head 10 even though no sheet P is conveyed. For this reason, the recognition unit 134 recognizes the entire surface as the second region F when paper jam occurs. In addition to the above, when purging (i.e. an operation to impart pressure to the ink in the heads 10 by driving the pump so as to eject the ink from all ejection openings) is carried out and a large amount of ink is ejected, it is also assumed in the same manner as the paper jam that a large amount of ink adheres to the entirety of the surface. For this reason, the entirety of the outer surface 8*a* is recognized as the second region F, when purging is carried out. It is noted that the "predetermined amount" of adhering ink in the arbitrary range identical in size with the enclosed range may be arbitrarily determined as long as the amount is not zero. The "predetermined amount", however, is preferably determined so that, when the ejection surfaces 10*a* are entirely covered with the annular component 71 and the outer surface 8*a*, the ink adhering to the outer surface 8*a* absorbs the moisture of the ink around the ejection openings 10*b* and hence the ink in the ejection openings 10*b* rapidly dries faster than a predetermined rate. In addition to the above, the recognition unit 134 recognizes the region wiped by the wiping mechanism 60 in the outer surface 8*a* as the first region G. In other words, even after recognizing that the entirety of the outer surface 8*a* of the conveyance belt 8 is the second region F, the recognition unit 134 further recognizes a region of the outer surface 8*a* which region has been wiped by the wiping mechanism 60 as the first region G, because an amount of ink remaining in that region is small.

When the activity log of the printer 1 indicates that preliminary ejection (i.e. an operation to cause the ejection openings 10*b* to eject ink onto the preliminary ejection region H based on preliminary ejection data different from the image data) has been performed, the recognition unit 134 recognizes the preliminary ejection region H as the second region F and recognizes the region other than the region H as the first region G based on the activity log.

The capping control unit 135 controls the motor 77 of the moving mechanism 72 and the conveyance motor 121 of the conveying unit 21 to carry out the capping such that the first region G recognized by the recognition unit 134 contacts the annular component 71 and the ejection surfaces 10*a* are entirely covered with the annular component 71 and the first region G. The capping control unit 135 performs the capping by controlling the moving mechanism 72 and moving the annular component 71 from the retracted position (indicated in FIG. 5A) to the contact position (indicated by FIG. 5B). The capping control unit 135 makes it possible to select one of provisional capping and definitive capping by controlling the moving mechanism 72. The pressure of the annular component 71 onto the outer surface 8*a* during the provisional capping is lower than the pressure of the annular component 71 onto the outer surface 8*a* during the definitive capping. More specifically, the capping control unit 135 controls the moving mechanism 72 so that the position of the annular component 71 during the definitive capping is lower than the position during the provisional capping.

The preliminary ejection control unit 136 controls the heads 10 and the conveying unit 21 (conveyance motor 121) so that ink is ejected from the ejection openings 10*b* of the heads 10 to the preliminary ejection region H based on preliminary ejection data which is different from the image data which is supplied from an external apparatus. While the preliminary ejection is performed on the preliminary ejection region H in the present embodiment, the preliminary ejection may be performed on the entirety of the outer surface 8*a*.

Now, referring to FIG. 8, the details of the maintenance carried out by the control unit 1*p* will be described. The steps below are executed by the CPU 101 based on programs stored in the ROM 102.

Figure 8:
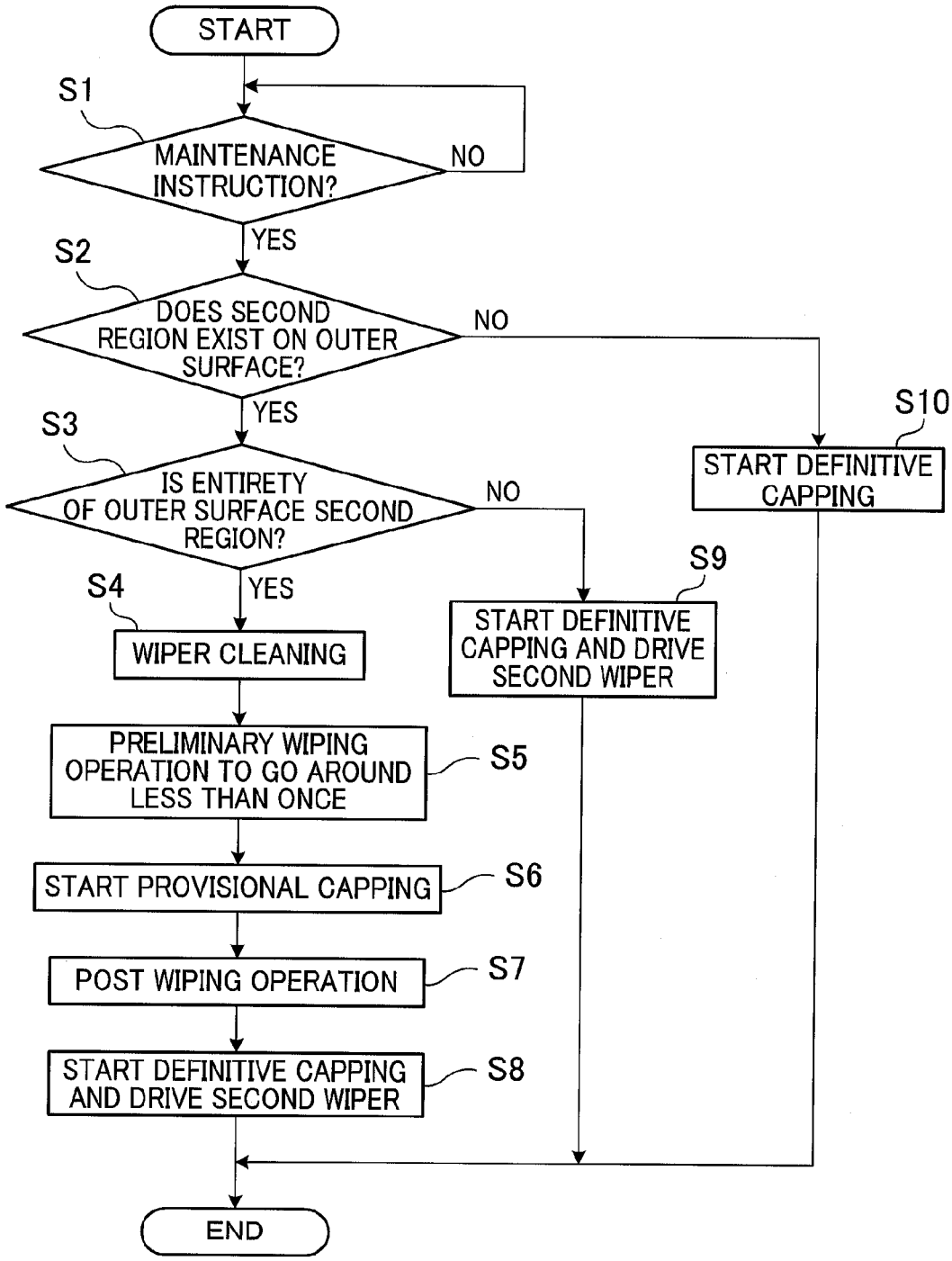
FIG. 8 is a flowchart of the maintenance operation in the printer.

First, the control unit 1*p* determines, as shown in FIG. 8, whether a maintenance instruction for capping has been received (S1). The maintenance instruction is received, for example, in the following cases: after the power on of the printer 1; when paper jam occurs after purging or preliminary ejection is carried out for the outer surface 8*a* of the conveyance belt 8; and when recording operations are not carried, out for a predetermined period.

If no maintenance instruction is received in S1 (S1: NO), the control unit 1*p* is kept on standby. If the maintenance instruction is received in S1 (S1: YES), the control unit 1*p* proceeds to S2. In S2, based on the activity log stored in the storage unit 133, the recognition unit 134 recognizes whether the second region F exists on the outer surface 8*a*. When the activity log stored in the storage unit 133 does not show an operation involving adherence of ink to at least a part of the outer surface 8*a* (e.g. a recording operation with which ink mist involving an adhering ink amount larger than the predetermined amount seems to occur, paper jam, purging, and preliminary ejection) (S2: NO), the recognition unit 134 recognizes that the entirety of the outer surface 8*a* of the conveyance belt 8 is the first region G, and the process proceeds to S10. On the other hand, when the activity log shows an operation involving adherence of ink to at least a part of the outer surface 8*a* (S2: YES), the recognition unit 134 recognizes that the second region F corresponding to the operation exists on the outer surface 8*a*, and the process proceeds to S3. When the activity log shows an operation involving adherence of ink to at least a part of the outer surface 8*a* (e.g. a recording operation with which ink mist involving an adhering ink amount larger than the predetermined amount seems to occur, paper jam, and purging) (S2: YES), the recognition unit 134 recognizes that the entirety of the outer surface 8*a* is the second region F and hence no first region G exists. In this case, on the outer surface 8*a*, the later-described region wiped in the preliminary wiping operation is recognized as the first region G by the recognition unit 134.

Subsequently, in S3, the control unit 1*p* determines whether the entirety of the outer surface 8*a* is the second region F, based on the activity log. When the entirety of the outer surface 8*a* is the second region F (S3: YES), the process proceeds to S4. When only the preliminary ejection region H of the outer surface 8*a* is recognized as the second region F (S3: NO), the process proceeds to S9. While the preliminary ejection is carried out only on the preliminary ejection region H in the present embodiment, the preliminary ejection may be carried out on the entirety of the outer surface 8*a*. In such a case the process skips S3 and proceeds to S4. On the other hand, when the ink ejected from the head by the purging adheres only to a particular region of the outer surface 8*a*, the process proceeds to S9.

In S4, the control unit 1*p* drives the motor 41M while the conveyance belt 8 being stopped, so as to rotate the main wiper 41 once clockwise in FIG. 1 about the axis along the main scanning directions. During this rotation, the leading end of the main wiper 41 contacts and is warped by the circumferential surface of the wiper cleaner 45. The foreign matters adhering to the leading end of the main wiper 41 are therefore transferred to the wiper cleaner 45 and removed therefrom (wiper cleaning).

The control unit 1*p* rotates the wiper cleaner 45 for a predetermined angle smaller than 360 degrees, each time the wiper cleaning (S4) is completed once or several times. This causes the leading end of the main wiper 41 to contact a different part of the wiper cleaner 45 in the wiper cleaning, and hence the foreign matters adhering to the leading end of the main wiper 41 are effectively removed.

Figure 9A:
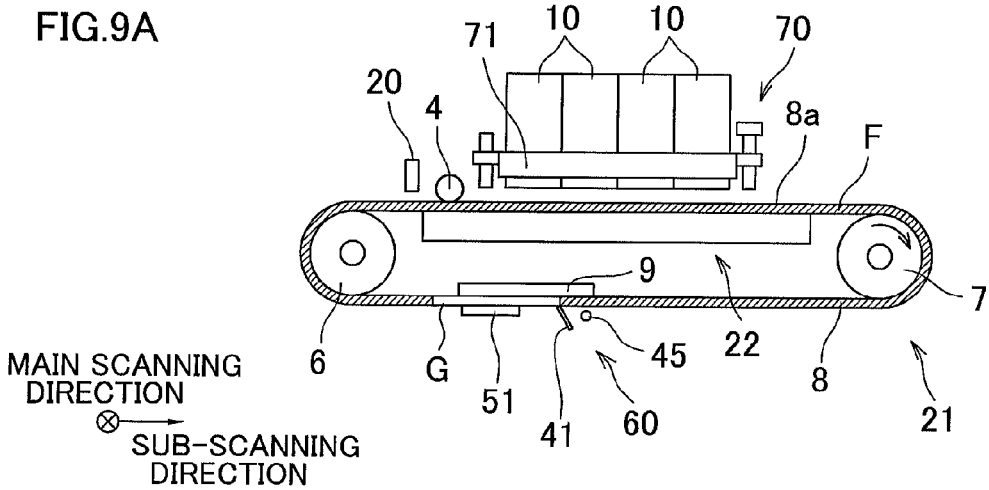
FIG. 9A to FIG. 9C is partial side elevations of the printer, showing the steps of the maintenance operation.

In S5, the first wiping execution unit 131 drives the motor 41M so as to slightly rotate the main wiper 41 about the axis along the main scanning directions and causes the leading end of the main wiper 41 distanced from the outer surface 8*a* of the conveyance belt 8 to contact the outer surface 8*a*. When the leading end of the main wiper 41 contacts and is warped by the outer surface 8*a*, the first wiping execution unit 131 stops the motor 41M. The first wiping execution unit 131 then drives the conveyance motor 121 to cause the conveyance belt 8 to go around less than once. As such, the foreign matters on the outer surface 8*a* of the conveyance belt 8 are gathered to a narrow range on the outer surface 8*a* and removed by the main wiper 41. More specifically, as shown in FIG. 9A, the conveyance belt 8 is moved while the main wiper 41 is in contact with the outer surface 8*a*, with the result that the outer surface 8*a* is wiped and the first region G is formed (preliminary wiping operation). It is noted that, in FIG. 9A to FIG. 9C, only the second region F is hatched.

Figure 9B:
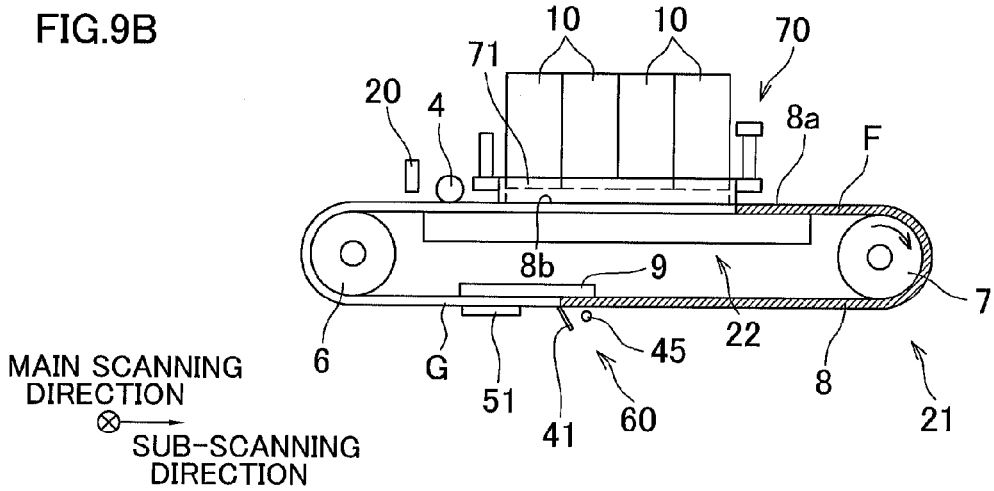

Subsequently, in S6, the capping control unit 135 stops the conveyance motor 121 when, as shown in FIG. 9B, the leading end of the first region G in the traveling direction faces the downstream end of the annular component 71 in the conveyance direction. The capping control unit 135 then controls the motor 77 so that the annular component 71 is moved from the retracted position to the contact position and the provisional capping starts. At the start of the provisional capping, as shown in FIG. 9B, a second region exists on the outer surface 8*a* of the conveyance belt 8, and the recognition unit 134 recognizes the existence of the second region.

Figure 9C:
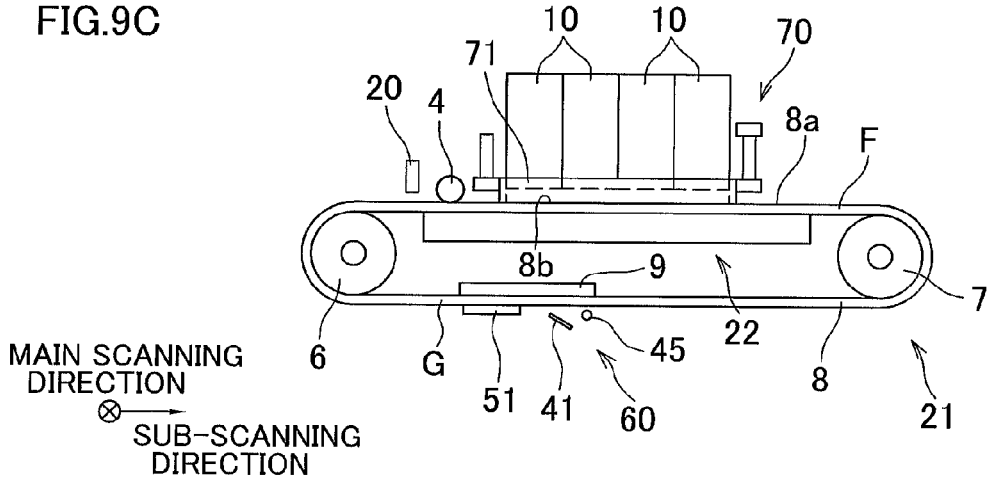

Thereafter, in S7, the first wiping execution unit 131 drives the conveyance motor 121 again to move the conveyance belt 8, and stops the conveyance motor 121 after the conveyance belt 8 goes around at least once including the movement for the preliminary wiping operation. As such, the conveyance belt 8 is moved while the capping is in action, and hence the leading end of the main wiper 41 contacts and is warped by the outer surface 8*a* whereas the conveyance belt 8 goes around at least once. As a result, as shown in FIG. 9C, the entirety of the outer surface 8*a* becomes the first region G. In other words, in S7 the second region F which is not wiped in the preliminary wiping operation is wiped (post wiping operation). Therefore the entirety of the outer surface 8*a* is wiped by the main wiper 41, and hence ink is hardly stuck on the outer surface 8*a*. Then the first wiping execution unit 131 drives the motor 41M while the conveyance belt 8 being stopped, so as to slightly rotate the main wiper 41 about the axis along the main scanning directions and cause the leading end of the main wiper 41 to be distanced from the outer surface 8*a*.

Thereafter, in S8, the second wiping execution unit 132 drives the conveyance motor 121 to move the conveyance belt 8, and stops the conveyance motor 121 when the part of the outer surface 8*a* which part contacts the main wiper 41 at the very moment when the main wiper 41 is detached from the outer surface 8*a* overlaps the center of the sub wiper 51 in the sub-scanning directions. In this case, the region of the outer surface 8*a* facing the annular component 71 is the first region G. Then the capping control unit 135 controls the motor 77 so that the pressure of the annular component 71 onto the outer surface 8*a* is higher than the pressure during the provisional capping (i.e. the definitive capping starts). This improves the tightness concerning the ejection surfaces 10*a* after the post wiping operation. Furthermore, since the pressure onto the outer surface 8*a* during the provisional capping is lower than the pressure onto the outer surface 8*a* during the definitive capping, the frictional force between the outer surface 8*a* and the annular component 71 is small when the conveyance belt 8 is moved while the provisional capping is conducted in the post wiping operation. This reduces the load caused by the travel of the conveyance belt 8.

During the definitive capping, the second wiping execution unit 132 drives the motor 59M forward. As a result, the leading end of the sub wiper 51 distanced from the outer surface 8*a* of the conveyance belt 8 is moved to contact the outer surface 8*a* and the sub wiper 51 is moved from the home position to the main scanning direction. Therefore the foreign matters on the outer surface 8*a* of the conveyance belt 8, i.e. the foreign matters remaining on the outer surface 8*a* after the main wiper 41 is detached therefrom are gathered to a narrow range and removed by the sub wiper 51 (second wiper drive). Therefore the ink hardly remains on the outer surface 8*a*. Consequently, ink hardly adheres to the surface of the sheet P facing the outer surface 8*a* when the sheet P is conveyed on the outer surface 8*a*, and hence the sheet P hardly gets dirty. In addition to the above, during the second wiper drive, the frictional force between the conveyance belt 8 and the annular component 71 is large due to the definitive capping. It is therefore possible to restrain the conveyance belt 8 from being displaced in the directions of the movement of the sub wiper 51 in the second wiper drive. The second wiping execution unit 132 temporarily stops the motor 59M when the sub wiper 51 reaches the other end of the plate 58 in the main scanning directions. At this point, the leading end of the sub wiper 51 is distanced from the outer surface 8*a* (see FIG. 4F) and contacts the sub wiper cleaner 55*a*. Thereafter, the second wiping execution unit 132 drives the motor 59M backward to move the sub wiper 51 backward in the main scanning direction (i.e. in the direction in reverse to the direction of the movement (indicated by the arrow in FIG. 3) of the sub wiper 51 during the removal of the foreign matters) (see FIG. 4G), and stops the motor 59M when the sub wiper 51 reaches the home position. As a result, the first and second wiper drives are completed and the ejection surfaces 10*a* are capped by the annular component 71.

In the meanwhile, in S9, the second wiping execution unit 132 causes the conveyance belt 8 to move by driving the conveyance motor 121, and stops the conveyance motor 121 when the center of the sub wiper 51 overlaps the center of the second region F (preliminary ejection region H) in the sub-scanning directions. At this point, since all regions of the conveyance belt 8 other than the preliminary ejection region H are the first region G, the region facing the annular component 71 is also the first region G. The capping control unit 135 then controls the motor 77 to move the annular component 71 from the retracted position to the contact position (i.e. the definitive capping starts). The motor 77 at this point is controlled so that the pressure of the annular component 71 onto the outer surface 8*a* is identical with the pressure in the definitive capping in S8.

After the annular component 71 is moved to the contact position, i.e. during the definitive capping, the second wiping execution unit 132 drives the motor 59M forward to perform the second wiper drive in the same manner as in S8, and temporarily stops the motor 59M when the sub wiper 51 reaches the other end of the plate 58 in the main scanning directions. Thereafter, the second wiping execution unit 132 drives the motor 59M backward to move the sub wiper 51 backward in the main scanning direction, and stops the motor 59M when the sub wiper 51 reaches the home position. The second wiper drive is finished in this way, and the ejection surfaces 10*a* are capped by the annular component 71.

In S10, the capping control unit 135 controls the motor 77 so that an arbitrary position of the outer surface 8*a* contacts the annular component 71 (i.e. the definitive capping starts). The motor 77 is controlled such that the pressure of the annular component 71 onto the outer surface 8*a* is identical with the pressure in the definitive capping in S8. As such, the ejection surfaces 10*a* are capped by the annular component 71.

As described above, in the printer 1 of the present embodiment, only the predetermined amount or less ink adheres to the arbitrary range which is identical in size with the enclosed range 8*b*, on the first region G of the outer surface 8*a* covering the ejection surfaces 10*a*. It is therefore possible to reduce the amount of thickened ink in the closed space formed by the capping, by performing the capping in such a way as to cause the first region G to contact the annular component 71. It is therefore possible to restrain the progress of the drying of the ink in the ejection openings 10*b*.

In S6, the provisional capping of the ejection surfaces 10*a* is carried out even if the second region F exists on the outer surface 8*a*. The capping control unit 135 can therefore perform the capping of the ejection surfaces 10*a* before the entirety of the outer surface 8*a* is wiped by the main wiper 41 to eliminate the second region F on the outer surface 8*a*. It is therefore possible to further restrain the drying of the ink in the ejection openings 10*b*.

In S5, the outer surface 8*a* is wiped before the capping so that the first region G is formed. As such, even if the entirety of the outer surface 8*a* is the second region F, it is possible to easily form the first region G by wiping a part of the outer surface 8*a* by the main wiper 41. In the first region G which is formed by wiping a part of the outer surface 8*a* by the main wiper 41, the amount of adhering ink is smaller than the amount in the first region G which is not formed by wiping. For this reason, it is possible to further restrain the progress of the drying of the ink in the capped ejection openings 10*b*, by setting the wiped region as the first region G.

In addition to the above, in S5 to S7, the conveyance belt 8 goes around less than once in the preliminary wiping operation, and the provisional capping is performed after this preliminary wiping operation. The post wiping operation is then carried out during the provisional capping, and the ink not wiped in the preliminary wiping operation is wiped away from the outer surface 8*a*. Since this arrangement shortens the time required for the preliminary wiping operation, the capping is carried out at an earlier timing. It is therefore possible to further restrain the drying of the ink in the ejection openings 10*b*.

In addition to the above, the recognition unit 134 recognizes a region to which no ink is ejected by the preliminary ejection as the first region G and recognizes a preliminary ejection region H to which ink is ejected by the preliminary ejection and the ink is not wiped away as the second region F. The structure is therefore simplified in comparison with recognition means which recognizes the first region G and the second region F by actually measuring an amount of ink adhering to the outer surface 8*a*. Furthermore, since the recognition unit 134 recognizes the position of the first region G (i.e. a region on the outer surface 8*a* which region is not the preliminary ejection region H) based on the activity log stored in the storage unit 133, the structure of the recognition means is further simplified.

Figure 10:
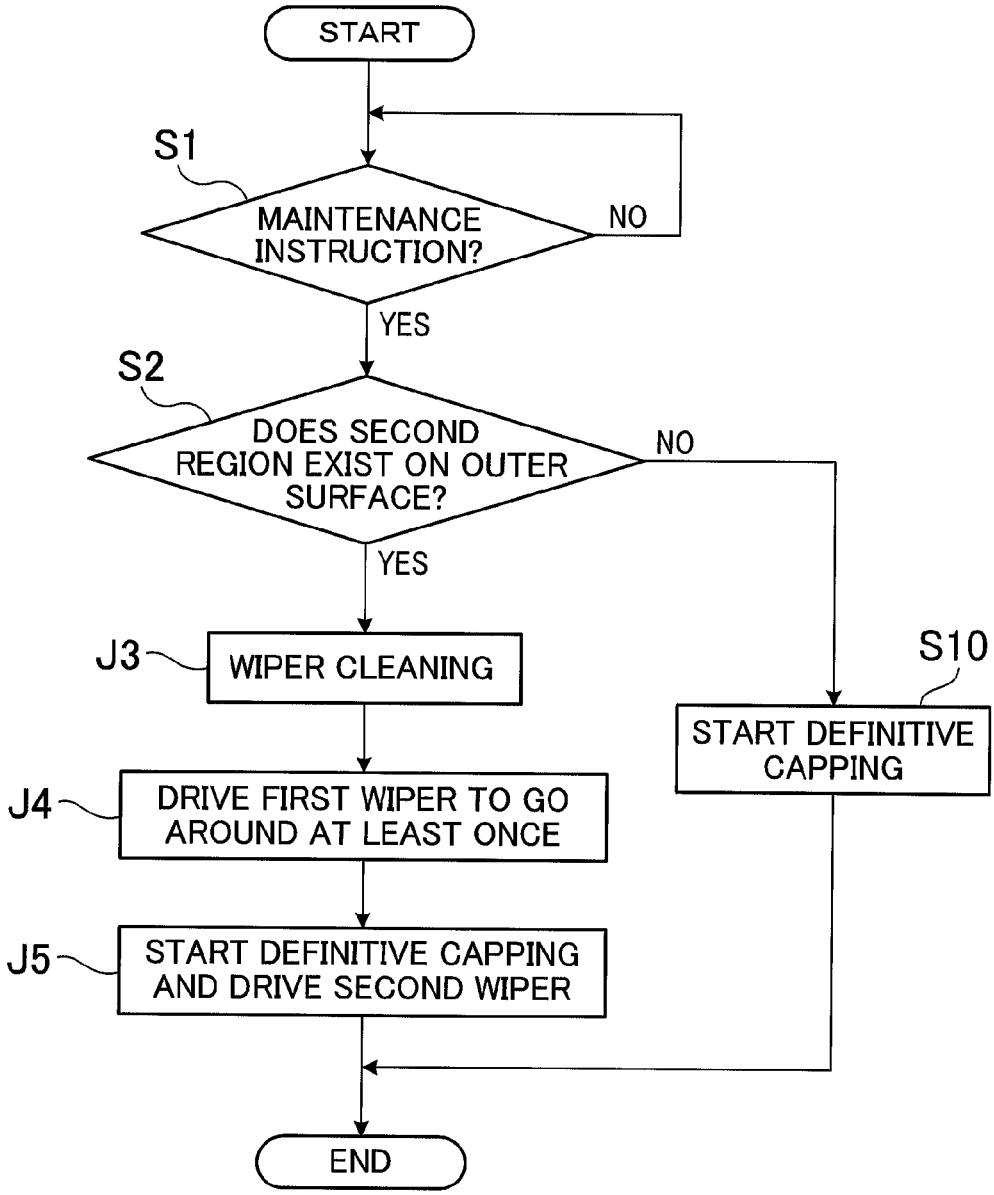
FIG. 10 is a flowchart of the maintenance operation in a first variation.

As a first variation, alternatively, when in S2 the recognition unit 134 recognizes that no second region F exists on the outer surface 8*a* and the entirety of the outer surface 8*a* is recognized as the first region G, the process proceeds to S10, whereas J3 and the subsequent steps are carried out as shown in FIG. 10 when it is recognized that the second region F exists on the outer surface 8*a*. In J3, the wiper cleaning is carried out in the same manner as S4 above.

Subsequently, in J4, the first wiping execution unit 131 drives the motor 41M to slightly rotate the main wiper 41 about the axis along the main scanning directions and causes the leading end of the main wiper 41 distanced from the outer surface 8*a* of the conveyance belt 8 to contact the outer surface 8*a*, and stops the motor 41M when the leading end of the main wiper 41 contacts and is warped by the outer surface 8*a*. After driving the conveyance motor 121 to cause the conveyance belt 8 to go round at least once, the first wiping execution unit 131 stops the conveyance motor 121. As a result, the foreign matters on the entirety of the outer surface 8*a* of the conveyance belt 8 are gathered to a narrow range on the outer surface 8*a* and removed by the main wiper 41. Consequently the first region G is formed on the entirety of the outer surface 8*a* (first wiper drive). The first wiping execution unit 131 then drives the motor 41M while the conveyance belt 8 being stopped, so as to slightly rotate the main wiper 41 about the axis along the main scanning directions and moves the leading end of the main wiper 41 away from the outer surface 8*a*.

Subsequently, in J5, the second wiping execution unit 132 drives the conveyance motor 121 to move the conveyance belt 8, and stops the conveyance motor 121 when a part of the outer surface 8*a* which part contacts the main wiper 41 at the very moment when the main wiper 41 is detached from the outer surface 8*a* overlaps the center of the sub wiper 51 in the sub-scanning directions. Since the entirety of the outer surface 8*a* is the first region G at this point, the region facing the annular component 71 is also the first region G. The capping control unit 135 then controls the motor 77 so that the annular component 71 moves from the retracted position to the contact position (i.e. the definitive capping starts). The motor 77 is controlled so that the pressure of the annular component 71 onto the outer surface 8*a* is identical with the pressure in the definitive capping in S8.

After the annular component 71 is moved to the contact position, i.e. during the definitive capping, the second wiping execution unit 132 drives the motor 59M forward to perform the second wiper drive similar to that of S8, and temporarily stops the motor 59M when the sub wiper 51 reaches the other end of the plate 58 in the main scanning directions. Thereafter, the second wiping execution unit 132 drives the motor 59M backward to move the sub wiper 51 backward in the main scanning directions, and stops the motor 59M when the sub wiper 51 reaches the home position. As such, the first and second wiper drives are finished and the ejection surfaces 10*a* are capped by the annular component 71.

Also in the first variation above, in the first region G of the outer surface 8*a* covering the ejection surfaces 10*a*, only the predetermined amount or less ink adheres to the arbitrary range identical in size with the enclosed range 8*b*, and hence it is possible to restrain the progress of the drying of the ink in the capped ejection openings 10*b*. Furthermore, since the entirety of the outer surface 8*a* is wiped in J4, the entirety of the outer surface 8*a* becomes the first region G and the capping can be carried out at an arbitrary position on the outer surface 8*a*. Also, the control structure becomes simple. In addition to the above, ink hardly remains on the outer surface 8*a* on account of the second wiper drive. Consequently; ink hardly adheres to the surface of the sheet P facing the outer surface 8*a* when the sheet P is conveyed on the outer surface 8*a*, and hence the sheet P hardly gets dirty.

According to a second variation, the process proceeds to J3 in FIG. 10 when the condition in S3 in FIG. 8 is satisfied (S3: YES). In other words, the steps J3 to J5 similar to those in the first variation are carried out only when the entirety of the outer surface 8*a* is the second region F. Effects similar to the above are achieved in this case. Also, the control structure becomes simple.

According to a third variation, when in S2 shown in FIG. 8 and FIG. 10 the recognition unit 134 recognizes that no second region F exists on the outer surface 8*a* and the entirety of the outer surface 8*a* is the first region G, the process proceeds to S10. When the recognition unit 134 recognizes that there is a second region F on the outer surface 8*a*, the process skips S3 and proceeds to S4. Also in this case, it is possible to restrain the progress of the drying of the ink in the capped ejection openings 10*b*, in the same manner as the embodiment above. Also, the control structure becomes simple.

According to another variation, there is recognition means which is arranged such that an image sensor having a detection surface facing the entire width of the outer surface 8*a* is provided, the image sensor detects the first region G and the second region F on the outer surface 8*a*, and a recognition unit 134 recognizes the positions of the first region G and second region F on the outer surface 8*a* based on the detection signal. This arrangement improves the accuracy of the recognition of the first region G and the second region F on the outer surface 8*a*.

In addition to the above, the wiping mechanism 60 may not be provided. In this case, based on the received maintenance instruction, the capping control unit controls the moving mechanism 72 and the conveying unit 21 so that the first region G recognized by the recognition unit 134 contacts the annular component 71. In addition to the above, the wiping mechanism may have only one of the main wiping mechanism 40 and the sub wiping mechanism 50. The main wiper 41 may extend in the directions orthogonal to both the main scanning directions and the sub-scanning directions. In addition to the above, the sub wiper 51 may extend in the directions orthogonal to both the main scanning directions and the sub-scanning directions. In addition to the above, in the second wiper drive, the sub wiper 51 may move in a direction orthogonal to both the main scanning directions and the sub-scanning directions. In addition to the above, in the first wiper drive, the main wiper 41 may be moved in the sub-scanning direction while either the conveyance belt 8 being stopped or the conveyance belt 8 being moved.

In addition to the above, recognition unit 134 may recognize only a position of the first region G on the outer surface 8*a*. In short, the second region F may not be recognized. In addition to the above, the preliminary ejection control unit 136 may not be provided.

In addition to the above, the conveyance mechanism may have a rotational drum instead of the conveyance belt. The main and sub wipers may not be blade-shaped and may be variously shaped on condition that foreign matters on a surface of a conveyance component are removed by the relative movement of the leading end of the wiper with respect to the surface while the leading end contacts the surface.

The present invention may be used in all line-type and serial-type inkjet recording apparatuses. Also, the present invention may be used not only for printers but also for other apparatuses such as facsimile machines and photocopiers. The recording medium is not limited to sheets P but may be various recordable media.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet recording apparatus comprising:

a record head having an ejection surface on which a plurality of ejection openings ejecting aqueous ink are formed;

a conveyance mechanism which has a conveyance surface passing through a position facing the ejection surface and conveys, by moving the conveyance surface in a travel direction, a recording medium supported on the conveyance surface so as to cause the recording medium to pass through the position facing the ejection surface;

a capping mechanism which has a annular component provided around the record head to circumscribe the record head and achieves capping such that the ejection surface is covered with the conveyance surface and the annular component as the annular component is caused to contact the conveyance surface;

a recognition unit which recognizes a position of a first region on the conveyance surface when the annular component does not contact the conveyance surface, the first region being not smaller than an enclosed range on the conveyance surface whose range is circumscribed by the annular component and being a region in which a predetermined amount or less ink adheres to an arbitrary range which is within the first region and is identical in size with the enclosed range; and a control unit which controls the capping mechanism and the conveyance mechanism so that the capping is achieved in such a way that the first region of the conveyance surface recognized by the recognition unit contacts the annular component.

2. The inkjet recording apparatus according to claim 1, wherein, the recognition unit recognizes the existence of a second region on the conveyance surface when the annular component does not contact the conveyance surface, the second region being not smaller than the enclosed range and being a region in which the predetermined amount or more ink is determined to adhere to an arbitrary range which is within the second region and is identical in size with the enclosed range, and the control unit controls the capping mechanism and the conveyance mechanism so that the capping is achieved in such a way that the first region of the conveyance surface contacts the annular component during a period in which the recognition unit recognizes that the second region exists on the conveyance surface.

3. The inkjet recording apparatus according to claim 1, further comprising:

a wiping unit which includes a first wiper which contacts or is detached from the conveyance surface, extends in directions orthogonal to the travel direction and along the conveyance surface, and wipes ink on the conveyance surface by moving relative to the conveyance surface in the travel direction while contacting the conveyance surface, wherein, the conveyance surface is a ring-shaped continuous surface, and before the capping, the control unit controls the conveyance mechanism and the wiping unit such that the first region is formed by moving the first wiper round relative to the conveyance surface at least once while keeping the first wiper contacting the conveyance surface.

4. The inkjet recording apparatus according to claim 2, further comprising:

a wiping unit which wipes ink adhering to the conveyance surface, wherein, the control unit controls the conveyance mechanism and the wiping unit so that the second region of the conveyance surface is wiped by the wiping unit during a period in which the capping is achieved in such a way that the first region contacts the annular component.

5. The inkjet recording apparatus according to claim 3, wherein, the wiping unit further includes a second wiper which contacts or is detached from the conveyance surface, extends in the travel direction, and wipes ink on the conveyance surface by moving relative to the conveyance surface in a direction orthogonal to be travel direction while contacting the conveyance surface, and the control unit controls the conveyance mechanism and the wiping unit so that ink remaining on the conveyance surface after the first wiper is detached from the conveyance surface is wiped by the second wiper.

6. The inkjet recording apparatus according to claim 4, further comprising:

a preliminary ejection control unit which controls the record head so that preliminary ejection of ink is performed from the plurality of ejection openings to the conveyance surface, wherein, the recognition unit recognizes a position of a region (i) on the conveyance surface as a position of the first region and recognizes a position of another region (ii) on the conveyance surface as a position of the second region, the region (i) being a region where no ink is ejected by the preliminary ejection whereas the another region (ii) being a region where the ink is ejected by the preliminary ejection and is not wiped by the wiping unit.

7. The inkjet recording apparatus according to claim 4, wherein, before the capping, the control unit controls the conveyance mechanism and the wiping unit so that the first region is formed by wiping the conveyance surface by the wiping unit.

8. The inkjet recording apparatus according to claim 7, wherein, the wiping unit includes a first wiper which contacts or is detached from the conveyance surface, extends in directions orthogonal to the travel direction, and wipes ink on the conveyance surface by moving relative to the conveyance surface in the travel direction while contacting the conveyance surface, the conveyance surface is a ring-shaped continuous surface, and before the capping, the control unit controls the conveyance mechanism and the wiping unit so as to perform a first wiping operation such that the first region is formed by moving the first wiper round relative to the conveyance surface less than once while keeping the first wiper contacting the conveyance surface, and during the capping, the control unit controls the conveyance mechanism and the wiping unit to perform a second wiping operation such that the conveyance surface, including the second region, not wiped in the first wiping operation is wiped by moving the first wiper relative to the conveyance surface while keeping the first wiper contacting the conveyance surface.

9. The inkjet recording apparatus according to claim 8, wherein, the wiping unit further includes a second wiper which contacts or is detached from the conveyance surface, extends in the travel direction, and wipes ink on the conveyance surface by moving relative to the conveyance surface in a direction orthogonal to the travel direction while contacting the conveyance surface, wherein, the control unit controls the conveyance mechanism and the wiping unit such that ink remaining on the conveyance surface after the first wiper is detached from the conveyance surface is wiped by the second wiper.

10. The inkjet recording apparatus according to claim 8, wherein, after the second wiping operation, the control unit controls the capping mechanism so that a pressure larger than a pressure of the annular component onto the conveyance surface during the second wiping operation is applied from the annular component to the conveyance surface.

* * * * *